US011599034B2

(12) United States Patent
Tokimitsu et al.

(10) Patent No.: US 11,599,034 B2
(45) Date of Patent: Mar. 7, 2023

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Ryoichi Tokimitsu, Chiba (JP); Naoto Kameyama, Tokyo (JP); Eileen Takeuchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/150,603

(22) Filed: Jan. 15, 2021

(65) Prior Publication Data

US 2021/0240092 A1 Aug. 5, 2021

(30) Foreign Application Priority Data

Jan. 30, 2020 (JP) ..... JP2020-014164

(51) Int. Cl.
*G03G 5/07* (2006.01)
*G03G 5/05* (2006.01)
*G03G 5/047* (2006.01)

(52) U.S. Cl.
CPC ..... *G03G 5/047* (2013.01); *G03G 5/0539* (2013.01); *G03G 5/071* (2013.01); *G03G 2215/00957* (2013.01)

(58) Field of Classification Search
CPC ..... G03G 5/047; G03G 5/0539; G03G 5/071; G03G 2215/00957; G03G 2215/00518
See application file for complete search history.

(56) References Cited

FOREIGN PATENT DOCUMENTS

| | | | | |
|---|---|---|---|---|
| JP | 06332219 | A | | 12/1994 |
| JP | 2000066425 | A | | 3/2000 |
| JP | 2001194810 | A | * | 7/2001 |
| JP | 2009104145 | A | | 5/2009 |
| JP | 2019007994 | A | * | 1/2019 |

OTHER PUBLICATIONS

"Machine Translation of publication # JP 2019007994 A" (Year: 2019).*
"Machine Translation of publication # JP 2001194810 A" (Year: 2001).*

* cited by examiner

*Primary Examiner* — Peter L Vajda
*Assistant Examiner* — Boone Alexander Evans
(74) *Attorney, Agent, or Firm* — Canon U.S.A., Inc., IP Division

(57) ABSTRACT

An electrophotographic photosensitive member that has an electroconductive support and a photosensitive layer on the electroconductive support, and reduces image failures. The surface layer of the electrophotographic photosensitive member includes a cured product of a composition of: a charge transporting compound having a specific polymerizable functional group; a polytetrafluoroethylene particle having a specific primary particle diameter; and a polymer having specific structural units and having weight average molecular weight.

7 Claims, 1 Drawing Sheet

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

Field of the Invention

The present disclosure relates to an electrophotographic photosensitive member, and a process cartridge and an electrophotographic apparatus each having the electrophotographic photosensitive member.

Description of the Related Art

An electrophotographic photosensitive member to be mounted on an electrophotographic apparatus includes an organic electrophotographic photosensitive member (hereinafter, referred to as "electrophotographic photosensitive member") containing an organic photoconductive substance (charge generation substance), and such an electrophotographic photosensitive member has been heretofore widely studied. In recent years, for the purpose of extending the life of the electrophotographic photosensitive member and enhancing an image quality, the electrophotographic photosensitive member is required to have mechanical durability (abrasion resistance) and show less change in electrical characteristics, which occurs due to long-term service.

Japanese Patent Application Laid-Open No. 2000-066425 describes a method for improving the mechanical durability of the electrophotographic photosensitive member and stabilizing the electrical characteristics, by imparting a polymerized product obtained by polymerizing a charge transporting substance which has a specific polymerizable functional group, to the outermost surface layer of the electrophotographic photosensitive member.

On the other hand, it becomes difficult for the surface of the electrophotographic photosensitive member to be refreshed, as the abrasion resistance of the electrophotographic photosensitive member becomes high, and accordingly, it is further required to suppress an increase in a frictional force with a blade through long-term use. In order to reduce the friction of the surface of the electrophotographic photosensitive member, polytetrafluoroethylene particles are incorporated into the surface layer as described in, for example, Japanese Patent Application Laid-Open No. H06-332219.

In addition, a method which uses a dispersant in combination for the purpose of enhancing dispersibility of the polytetrafluoroethylene particles is known. The dispersant is required to have a surface-active function and not to adversely affect electrophotographic properties. As such a dispersant, for example, Japanese Patent Application Laid-Open No. 2009-104145 discloses a technology which satisfactorily disperse fluorine atom-containing particles in a surface layer, by using a fluorinated alkyl group having a specific structure and a polymer having a specific structural unit.

SUMMARY OF THE INVENTION

Among the charge transporting substances having a polymerizable functional group, the surface layer that contains a charge transporting compound having a chain polymerizable functional group such as an acryloyloxy group or a methacryloyloxy group as a polymerizable functional group has a high mechanical durability and an excellent charge transportability, and can provide satisfactory electrical characteristics. However, the surface layer is not easily scraped due to the high durability, and when images are output for a long period of time, it becomes easy for an image failure to occur. In addition, it is difficult for the polytetrafluoroethylene particles in the surface layer to be immediately removed by the blade, and accordingly when the primary particle diameter of the polytetrafluoroethylene particles is not appropriate, the concave and convex of the surface layer becomes large, the stability of the behavior of the blade decreases, and image failures (slipping through) tend to easily occur.

Accordingly, an aspect of the present disclosure is to provide an electrophotographic photosensitive member that has an electroconductive support and a photosensitive layer formed on the electroconductive support, and can achieve all of satisfactory electric characteristics, mechanical durability, and further satisfactory output images, in the output for a long period of time. In addition, another aspect of the present disclosure is to provide a process cartridge and an electrophotographic apparatus which have the electrophotographic photosensitive member.

The above aspect is achieved by the following present disclosure. Specifically, an electrophotographic photosensitive member according to the present disclosure is an electrophotographic photosensitive member including an electroconductive support and a photosensitive layer on the electroconductive support, wherein the electrophotographic photosensitive member comprises a surface layer including a cured product of a composition of: a charge transporting compound having a chain polymerizable functional group selected from the group consisting of chain polymerizable functional groups represented by the following Formulas (1) to (4); a polymer having a structural unit represented by the following Formula (5) and a structural unit represented by the following Formula (6), and having a weight average molecular weight of 60,000 or more and 129,000 or less; and a polytetrafluoroethylene particle, wherein a number-average particle diameter of primary particles of the polytetrafluoroethylene particle is 150 nm or larger and 195 nm or smaller, an abundance ratio of a polytetrafluoroethylene particle having a particle diameter of the primary particles of 150 nm or smaller among the polytetrafluoroethylene particles is 10% by number or more, and an abundance ratio of a polytetrafluoroethylene particle having a particle diameter of the primary particles of 250 nm or larger is 5% by number or less:

(1)

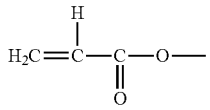

(2)

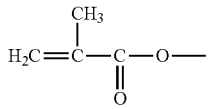

(3)

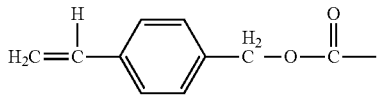

-continued (4)

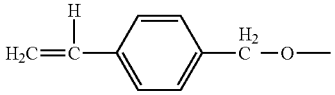

(5)

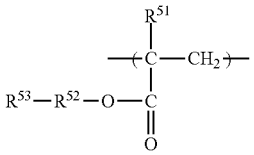

wherein $R^{51}$ represents a hydrogen atom or a methyl group, $R^{52}$ represents an alkylene group, and $R^{53}$ represents a perfluoroalkyl group having 4 or more and 6 or less carbon atoms;

(6)

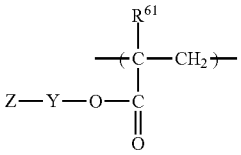

wherein $R^{61}$ represents a hydrogen atom or a methyl group, Y represents a divalent organic group having at least a structure represented by the following Formula (7), and Z represents the following Formula (8);

(7)

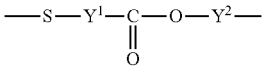

wherein $Y^1$ and $Y^2$ each independently represent an alkylene group; and (8)

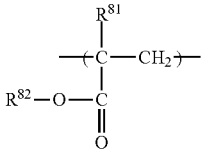

wherein $R^{81}$ represents a hydrogen atom or a methyl group, and $R^{82}$ represents an alkyl group.

In addition, the present disclosure is to provide a process cartridge that integrally supports the electrophotographic photosensitive member and at least one unit selected from the group consisting of a charging unit, a developing unit and a cleaning unit, and is detachably attachable to a main body of an electrophotographic apparatus.

In addition, the present disclosure is to provide an electrophotographic apparatus having the electrophotographic photosensitive member, the charging unit, the exposure unit, the developing unit and the transfer unit.

According to the present disclosure, there can be provided an electrophotographic photosensitive member that has an electroconductive support and a photosensitive layer on the electroconductive support, has mechanical durability, and can achieve both of the reduction of image failures and satisfactory electrical characteristics. In addition, according to the present disclosure, there can be provided a process cartridge and an electrophotographic apparatus that have each the electrophotographic photosensitive member.

Further features of the present disclosure will become apparent from the following description of exemplary embodiments with reference to the attached drawings.

DESCRIPTION OF THE EMBODIMENTS

Figure 1:
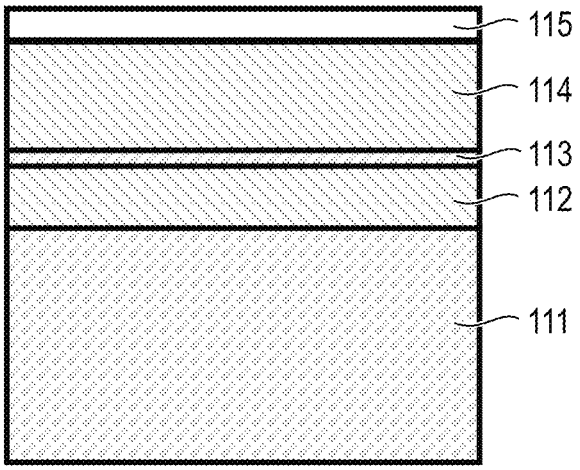
FIG. 1 illustrates a view illustrating one example of a layer configuration of the electrophotographic photosensitive member of the present disclosure.

Preferred embodiments of the present disclosure will now be described in detail in accordance with the accompanying drawings.

As described above, the present disclosure is characterized by an electrophotographic photosensitive member including an electroconductive support and a photosensitive layer on the electroconductive support, wherein the electrophotographic photosensitive member comprises a surface layer including a cured product of a composition of: a charge transporting compound having a chain polymerizable functional group selected from the group consisting of chain polymerizable functional groups represented by the following Formulas (1) to (4); a polymer having a structural unit represented by the following Formula (5) and a structural unit represented by the following Formula (6), and having a weight average molecular weight of 60,000 or more and 129,000 or less; and a polytetrafluoroethylene particle, wherein a number-average particle diameter of primary particles of the polytetrafluoroethylene particle is 150 nm or larger and 195 nm or smaller, an abundance ratio of a polytetrafluoroethylene particle having a particle diameter of the primary particles of 150 nm or smaller among the polytetrafluoroethylene particles is 10% by number or more, and an abundance ratio of a polytetrafluoroethylene particle having a particle diameter of the primary particles of 250 nm or larger is 5% by number or less:

(1)

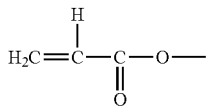

(2)

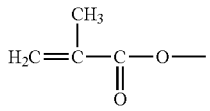

(3)

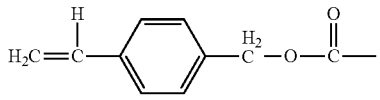

-continued (4)

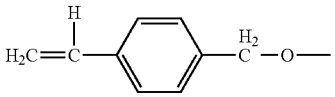

(5)

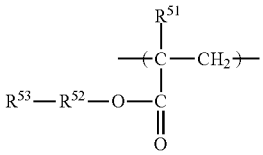

wherein $R^{51}$ represents a hydrogen atom or a methyl group, $R^{52}$ represents an alkylene group, and $R^{53}$ represents a perfluoroalkyl group having 4 or more and 6 or less carbon atoms;

(6)

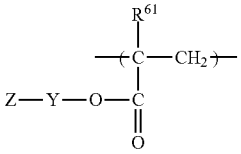

wherein $R^{61}$ represents a hydrogen atom or a methyl group, Y represents a divalent organic group having at least a structure represented by the following Formula (7), and Z represents the following Formula (8);

(7)

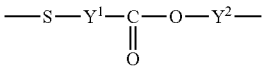

wherein $Y^1$ and $Y^2$ each independently represent an alkylene group; and (8)

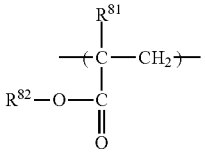

wherein $R^m$ represents a hydrogen atom or a methyl group, and $R^{82}$ represents an alkyl group.

It is preferable that the charge transporting compound having a chain polymerizable functional group selected from the group consisting of the chain polymerizable functional group represented by the (1), (2), (3) and (4) be a compound represented by the following Formula (a):

(a)

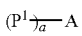

wherein $P^1$ is a univalent chain polymerizable functional group represented by Formulas (1), (2), (3) and (4); a is an integer of 1 to 4, and when a is 2 or larger, a pieces of $P^1$s may be the same or different; and A represents a charge transporting group, and a hydrogen adduct in which a bonding site of A to $P^1$ is substituted with a hydrogen atom is a compound represented by the following Formula (b) or the following Formula (c);

(b)

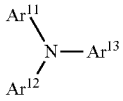

wherein $Ar^{11}$, $Ar^{12}$ and $Ar^{13}$ represent phenyl groups or biphenyl groups which may have each an alkyl group having 1 to 6 carbon atoms as a substituent, and in addition, $Ar^{11}$, $Ar^{12}$ and $Ar^{13}$ may be the same or different;

(c)

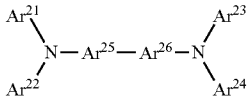

wherein $Ar^{21}$, $Ar^{22}$, $Ar^{23}$ and $Ar^{24}$ represent phenyl groups which may have each an alkyl group having 1 to 6 carbon atoms as a substituent, and $Ar^{25}$ and $Ar^{26}$ represent phenylene groups which may have each an alkyl group having 1 to 6 carbon atoms as a substituent, in addition, $Ar^{21}$, $Ar^{22}$, $Ar^{23}$ and $Ar^{24}$ may be the same or different, and $Ar^{25}$ and $Ar^{26}$ may be the same or different.

The present inventors assume the reason why the electrophotographic photosensitive member having a specific configuration according to the present disclosure reduces the image failures without impairing the mechanical durability and the satisfactory electrical characteristics, in the following way.

A certain amount of polytetrafluoroethylene particles having a small primary particle diameter exist, and polytetrafluoroethylene particles having a large primary particle diameter is do not almost exist; and thereby the stability of the behavior of a cleaning blade while the images are output increases. In addition, as for a dispersant for the polytetrafluoroethylene particle, a polymer having the structural unit represented by Formula (5) and the structural unit represented by Formula (6) tends to easily adsorb to the polytetrafluoroethylene particle; and when the molecular weight of the dispersant is within an appropriate range, the polytetrafluoroethylene particles uniformly exist in the surface layer due to steric repulsion between molecular chains of the dispersant, and the stability of the behavior of the cleaning blade while images are output increases for the electrophotographic photosensitive member. Furthermore, when the polytetrafluoroethylene particles are too small, the dispersant results in connecting the polytetrafluoroethylene particles with each other by one molecular chain, and accordingly, the aggregability of the polytetrafluoroethylene particles increases. Thereby, the concave and convex of the surface layer becomes large, and accordingly, it is assumed to be desirable that the number-average particle diameter of the polytetrafluoroethylene particles be within an appropriate range.

It is considered that due to the above description, the stability of the behavior of the cleaning blade while images are output increases and image failures are reduced.

Specific examples of the charge transporting compound having a chain polymerizable functional group selected from the group consisting of chain polymerizable functional groups represented by Formulas (1) to (4) of the present disclosure are shown below, but the present disclosure is not limited thereto.

(1-1)
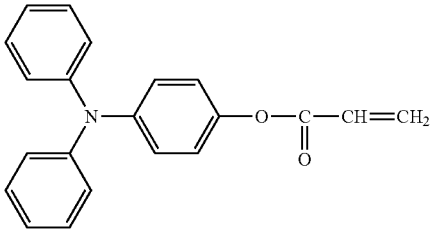
(1-2)
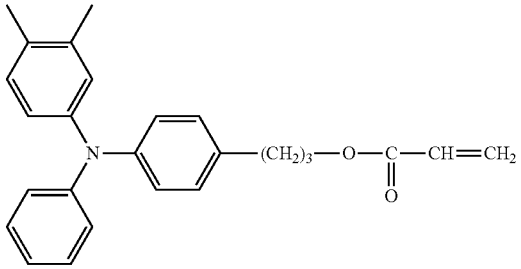
(1-3)
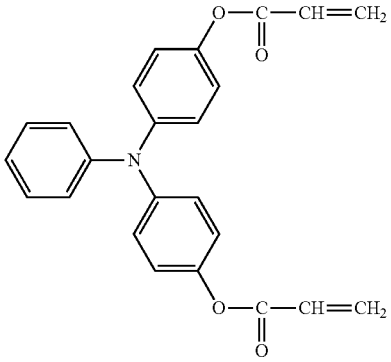
(1-4)
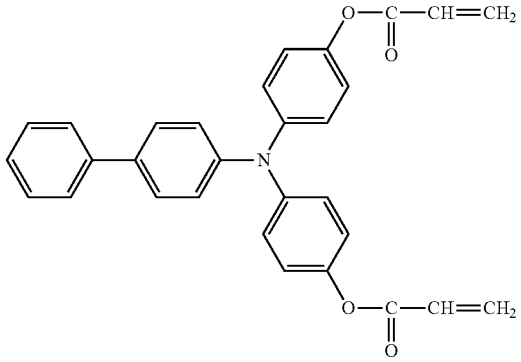
(1-5)
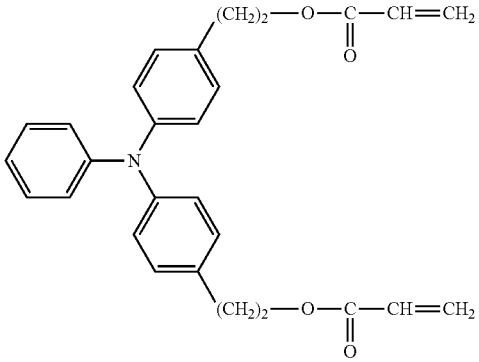
(1-6)
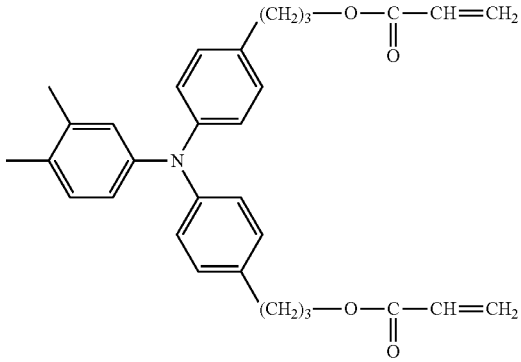
(1-7)
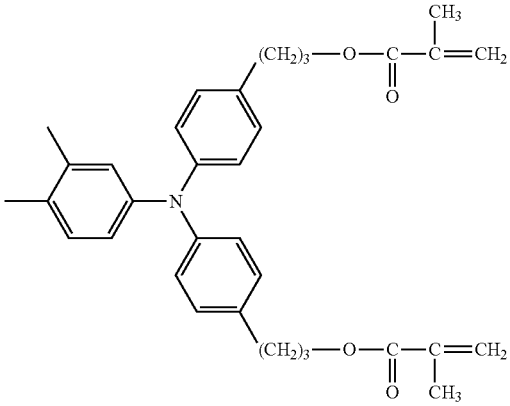
(1-8)
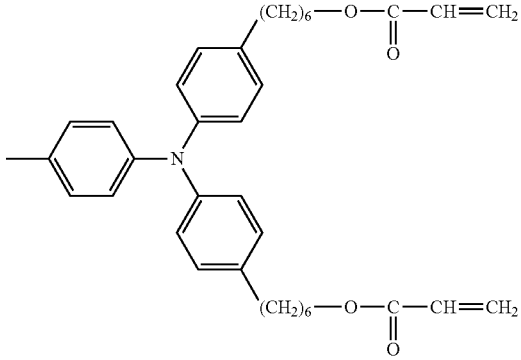

-continued
(1-9)
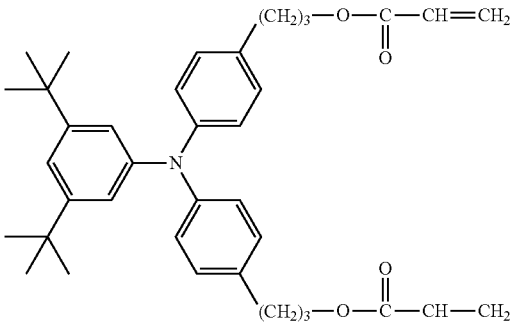
(1-10)
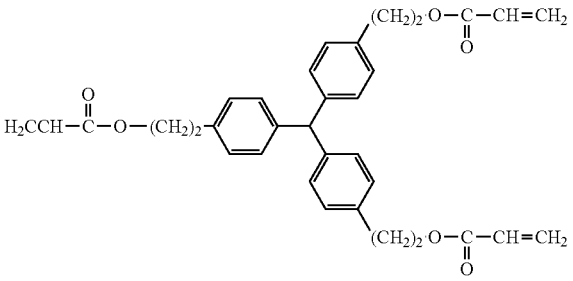
(1-11)
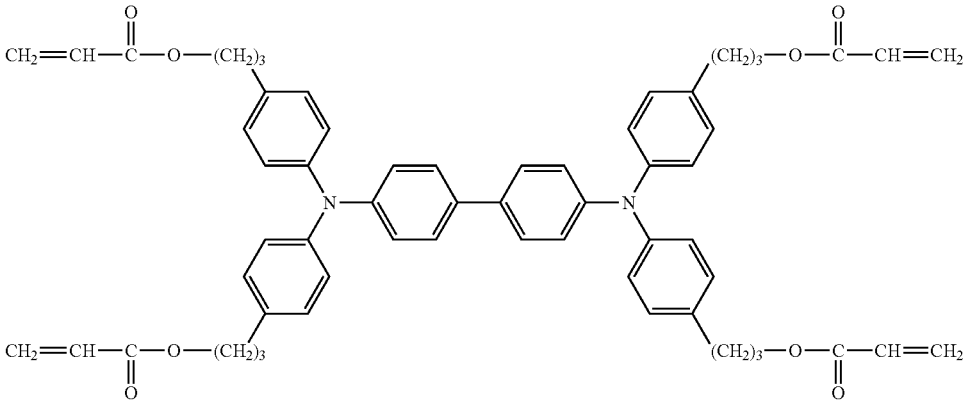
(1-12)
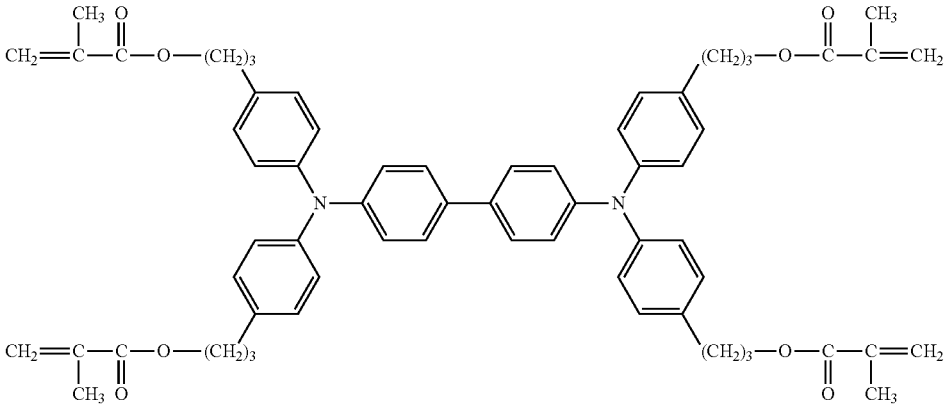
(1-13)
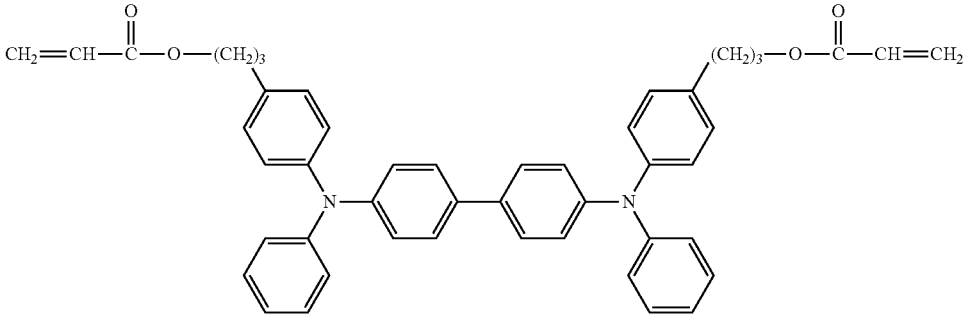

-continued
(1-14)
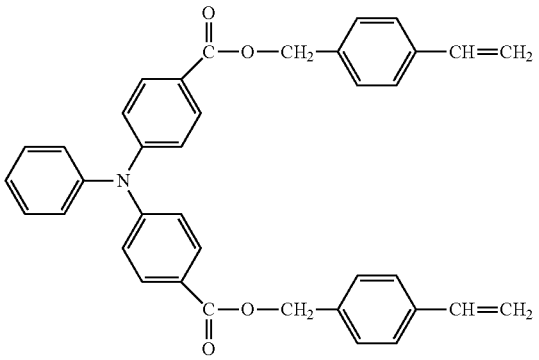
(1-15)
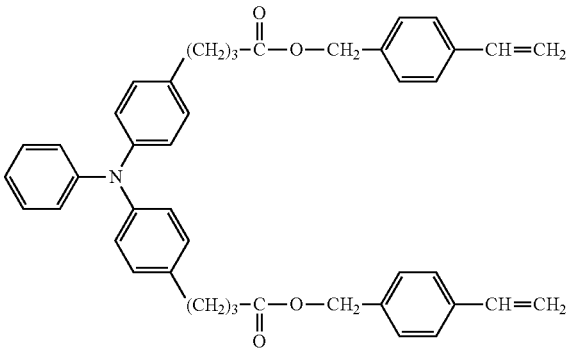
(1-16)
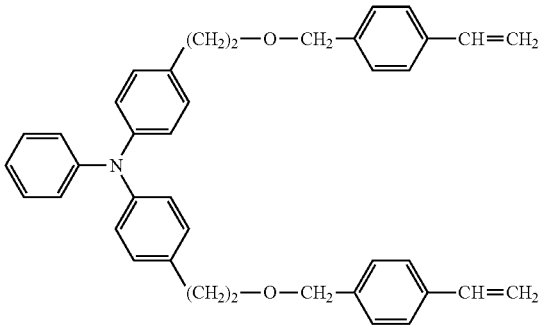
(1-17)
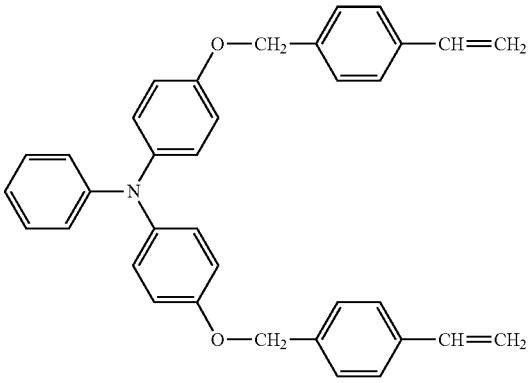
(1-18)
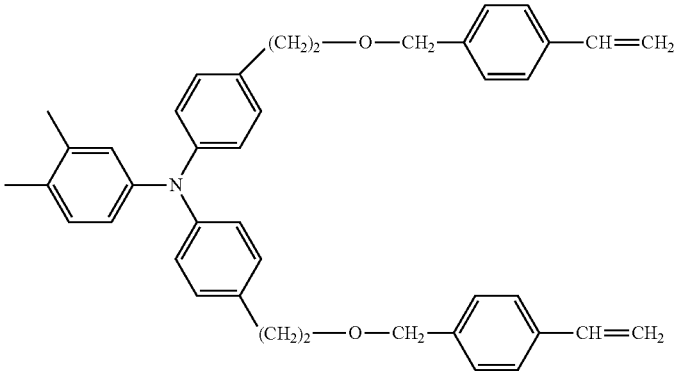
(1-19)
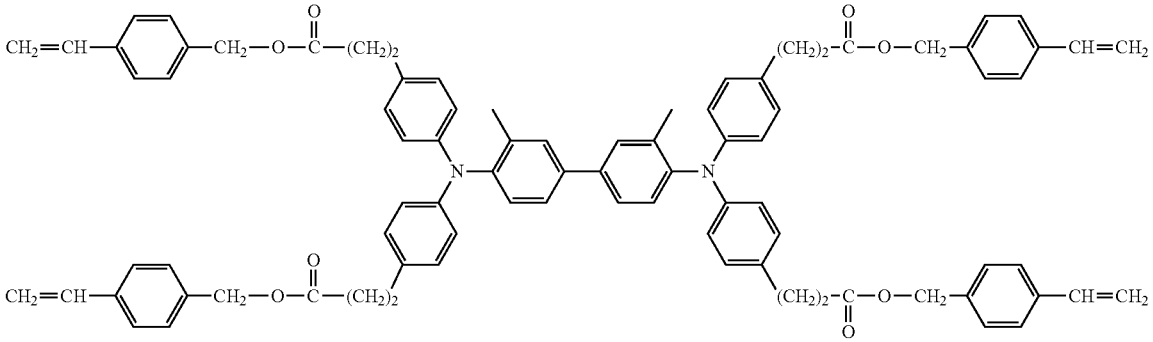

-continued (1-20)

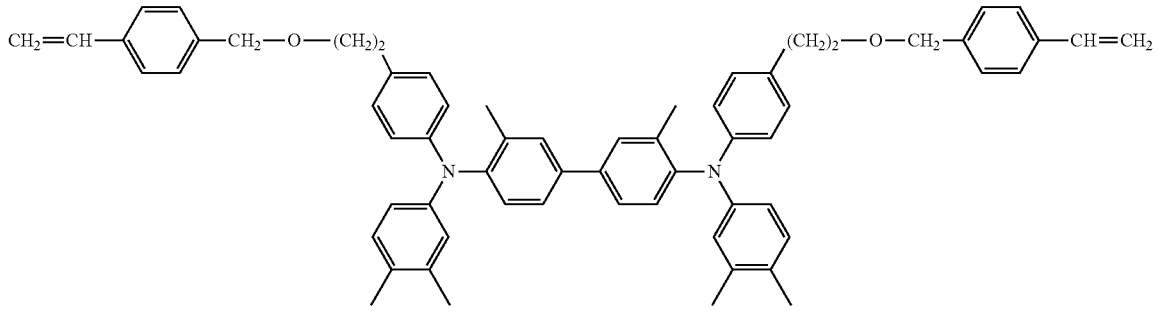

(1-21)

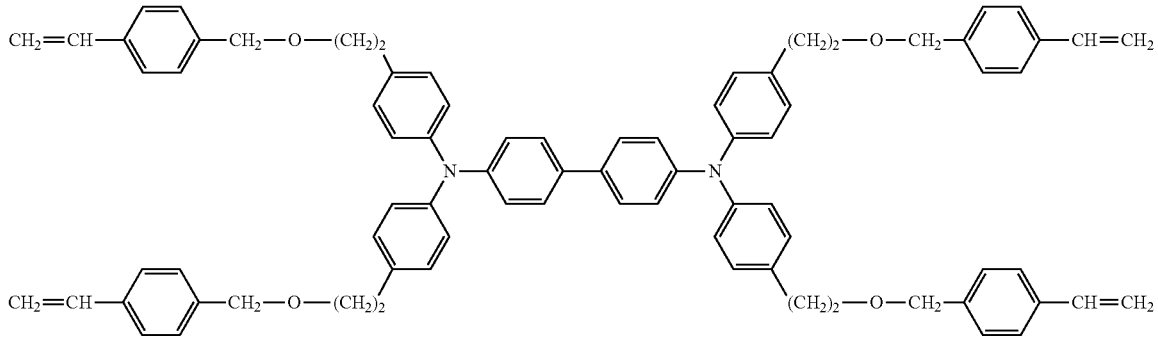

In the above Formulas (1-1) to (1-21), Formulas (1-5) to (1-7) are particularly preferable.

The form of copolymerization in the polymer is arbitrary which has the structural unit represented by Formula (5) and the structural unit represented by Formula (6). However, in order that the fluoroalkyl moiety having a high affinity for the polytetrafluoroethylene particle exhibits its function more effectively, a comb-shaped graft structure is more preferable which has the structural unit represented by Formula (5) in a side chain.

In addition, as for a copolymerization ratio of the structural unit represented by Formula (5) to the structural unit represented by Formula (6), in order to obtain the effects of the present disclosure, it is preferable that a molar ratio of the structural unit represented by Formula (5) to the structural unit represented by Formula (6) be 99:1 to 20:80. Furthermore, it is preferable that the molar ratio be 95:5 to 30:70.

$R^{52}$ in Formula (5) represents an alkylene group. Examples of the alkylene group include: linear alkylene groups such as a methylene group, an ethylene group, a propylene group, a butylene group, a pentylene group and a hexylene group; and branched alkylene groups such as an isopropylene group and an isobutylene group. Among the groups, a methylene group, an ethylene group, a propylene group and a butylene group are preferable.

Specific examples of the structural unit represented by Formula (5) of the present disclosure will be shown below, but the present disclosure is not limited to the examples.

(5-1)

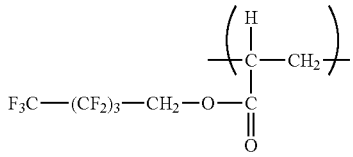

(5-2)

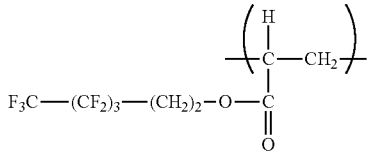

(5-3)

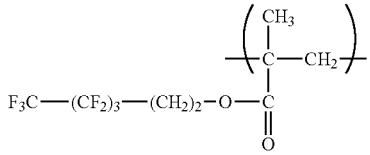

(5-4)

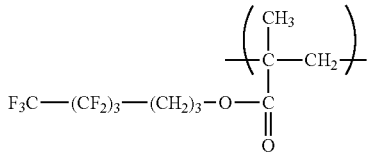

-continued (5-5)

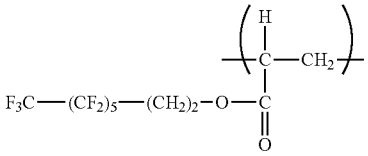

(5-6)

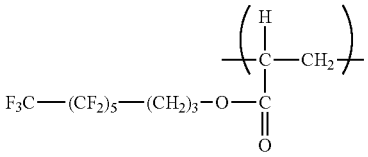

(5-7)

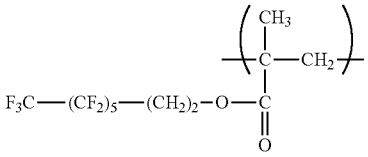

(5-8)

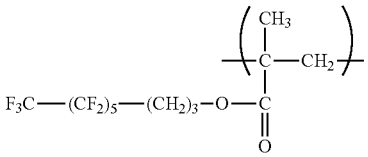

$Y^1$ and $Y^2$ in Formula (7) each independently represent an alkylene group which may have a substituent. Examples of the alkylene group include a methylene group, an ethylene group, a propylene group, a butylene group, a pentylene group and a hexylene group. Among the groups, the methylene group, the ethylene group and the propylene group are preferable. Examples of the substituent which these alkylene groups include an alkyl group, an alkoxyl group, a hydroxyl group and an aryl group. Examples of the alkyl group include a methyl group, an ethyl group, a propyl group and a butyl group. Among the groups, the methyl group and the ethyl group are preferable. Examples of the alkoxyl group include a methoxy group, an ethoxy group and a propoxy group. Among the groups, the methoxy group is preferable. Examples of the aryl group include a phenyl group and a naphthyl group. Among the groups, the phenyl group is preferable. In addition, among the groups, the methyl group and the hydroxyl group are more preferable.

$R^{82}$ in Formula (8) represents an alkyl group. Examples of the alkyl group include a methyl group, an ethyl group, a propyl group, a butyl group, a pentyl group, a hexyl group, a heptyl group, an octyl group and a nonyl group. Among the groups, the methyl group, the ethyl group, the propyl group, the butyl group, the pentyl group and the hexyl group are preferable.

Furthermore, it is preferable for the number-average particle diameter of the primary particles of the polytetrafluoroethylene particle to be 150 nm or larger and 195 nm or smaller, is more preferable to be 170 nm or larger and 190 nm or smaller, and is further preferable to be 180 nm or larger and 185 nm or smaller. Since a particle having a large particle diameter does not exist, the behavior of the cleaning blade while images are output becomes stable; and the dispersant is less likely to connect the polytetrafluoroethylene particles with each other by one molecular chain, and the polytetrafluoroethylene particles resists agglomerating with each other, which are preferable for the reduction of image failures. Furthermore, it is preferable for the reduction of the image failures that the number average molecular weight of the polytetrafluoroethylene particles be 12,000 or more and 20,000 or less. Furthermore, it is preferable for the reduction of the image failures that the content of the polytetrafluoroethylene particle in the surface layer of the electrophotographic photosensitive member be 20.0 mass % or more and 40.0 mass % or less with respect to the weight of the surface layer.

Furthermore, it is preferable that the cured product of the composition contain a charge transporting compound having a chain polymerizable functional group represented by the following Formula (9):

(9)

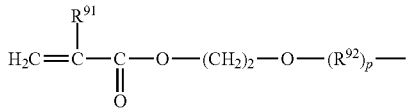

wherein $R^{91}$ represents a hydrogen atom or a methyl group, and $R^{92}$ represents an alkylene group; and p represents 0 or 1.

Specific examples of a charge transporting compound having a chain polymerizable functional group represented by Formula (9) will be shown below, but the present disclosure is not limited to the examples.

(9-1)

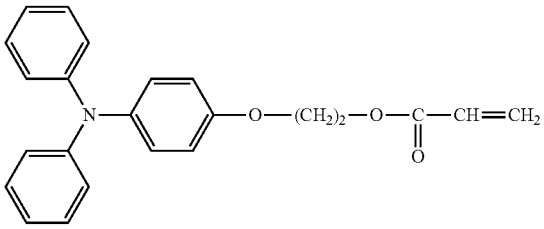

(9-2)

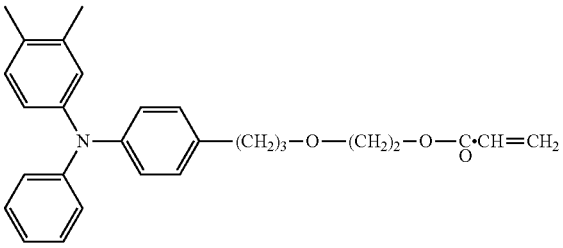

-continued
(9-3)
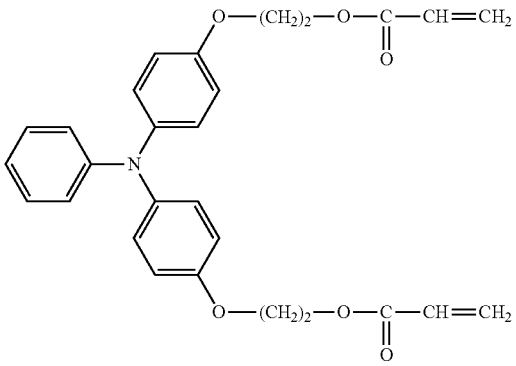
(9-4)
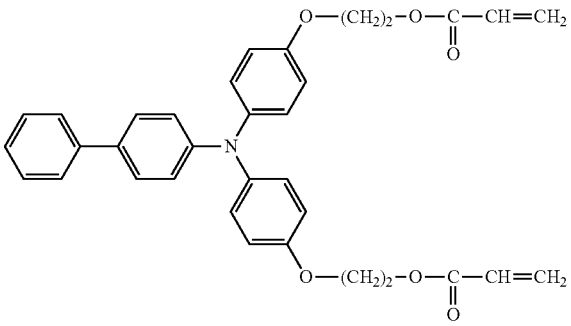
(9-5)
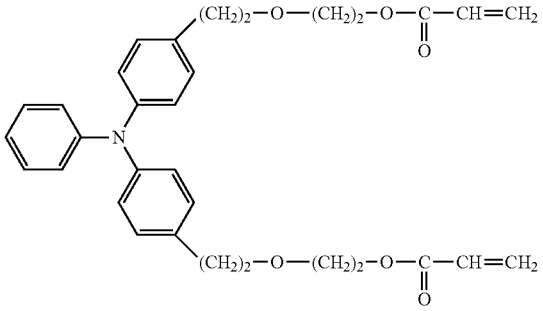
(9-6)
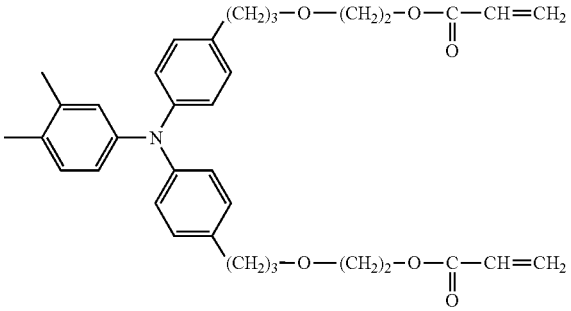
(9-7)
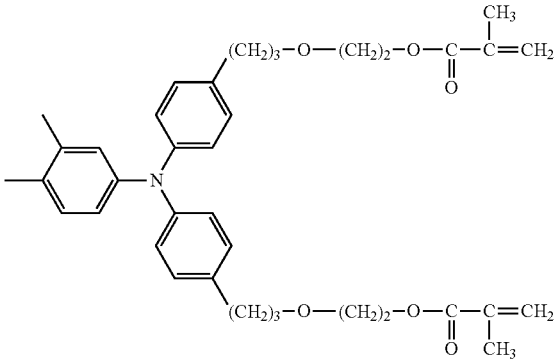
(9-8)
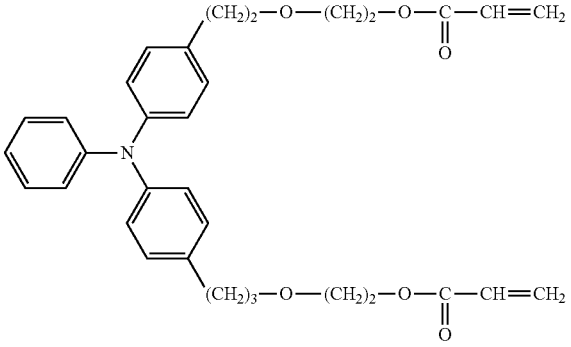
(9-9)
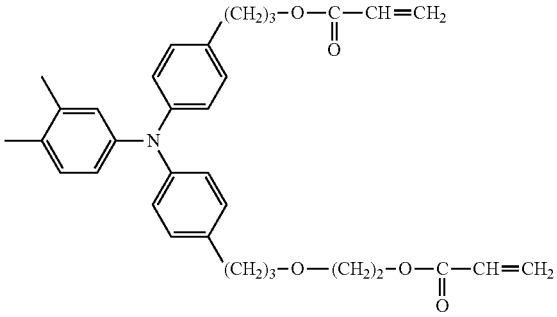
(9-10)
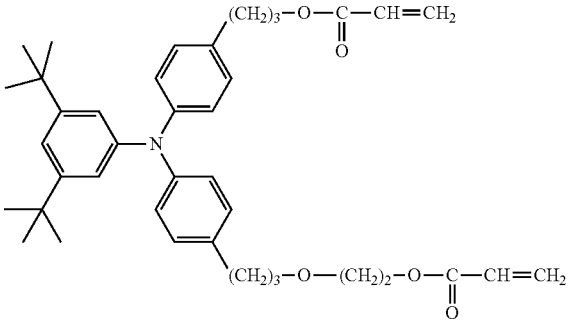

-continued (9-11)

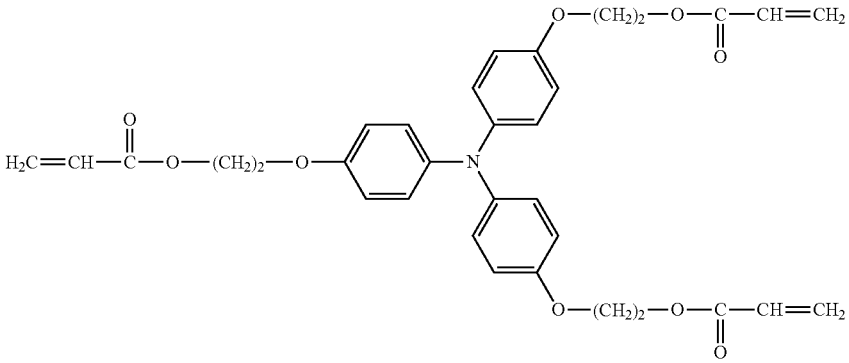

(9-12)

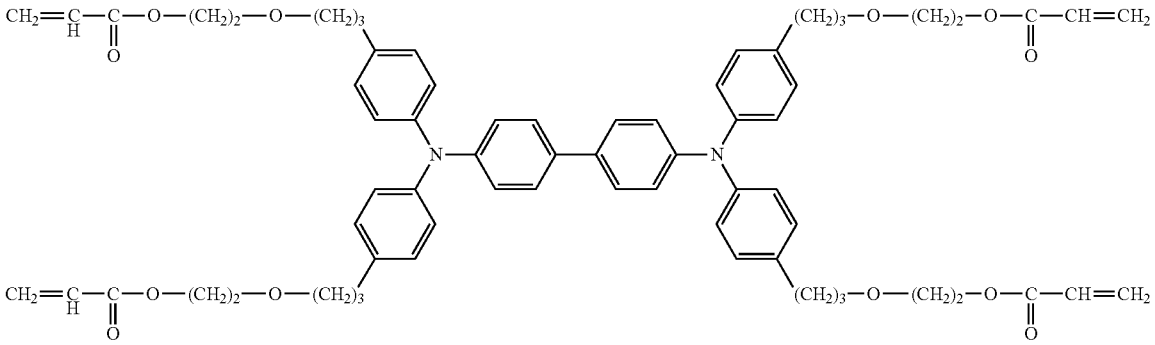

(9-13)

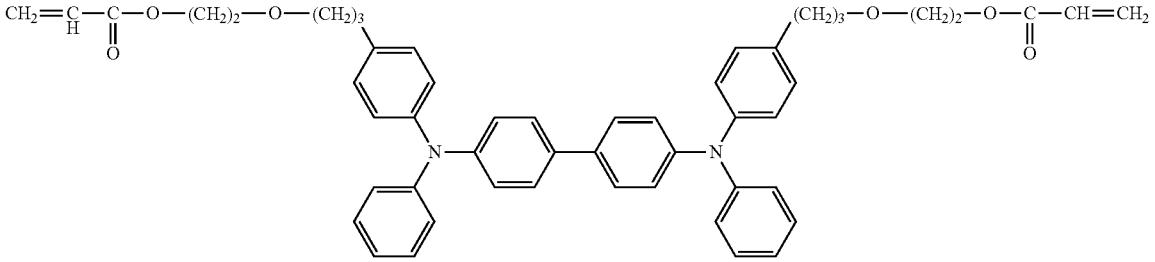

Next, the configuration of the electrophotographic photosensitive member to be used in the present disclosure will be described.

[Electrophotographic Photosensitive Member]

The electrophotographic photosensitive member of the present disclosure includes an electroconductive support and a photosensitive layer on the electroconductive support.

A preferable configuration of the electrophotographic photosensitive member in the present disclosure is a configuration in which a charge generation layer, a charge transport layer and a surface layer are layered in this order on the support. If necessary, an electroconductive layer or an undercoat layer may be provided between the support and the charge generation layer, and further, a protective layer may be provided on the surface layer. Note that the charge generation layer and the charge transport layer are collectively referred to as a photosensitive layer in the present disclosure.

In addition, the photosensitive layer in the present disclosure may be formed of a monolayer type photosensitive layer which contains a charge generation substance and a charge transporting compound.

FIG. 1 illustrates a view illustrating one example of a layer configuration of the electrophotographic photosensitive member.

As is illustrated in FIG. 1, the electrophotographic photosensitive member has a support 111, an undercoat layer 112, a charge generation layer 113, a charge transport layer 114 and a surface layer 115.

Then, as has been described above, the surface layer of the electrophotographic photosensitive member includes a cured product of a composition of: a charge transporting compound having a chain polymerizable functional group selected from the group consisting of chain polymerizable functional groups represented by Formulas (1) to (4); a polymer having a structural unit represented by Formula (5) and a structural unit represented by Formula (6), and having a weight average molecular weight of 60,000 or more and 129,000 or less; and a polytetrafluoroethylene particle.

Examples of a method for producing the electrophotographic photosensitive member of the present disclosure include a method for preparing a coating liquid for each layer, which will be described later, applying the coating liquid in the order of desired layers, and drying the coating liquids. Examples of a method for applying the coating liquid at this time include, dip coating, spray coating, inkjet coating, roll coating, die coating, blade coating, curtain coating, wire bar coating and ring coating. Among the coating methods, the dip coating is preferable in view of efficiency and productivity.

The support and each layer will be described below.

<Support>

In the present disclosure, the electrophotographic photosensitive member has an electroconductive support as a support. Examples of the shape of the electroconductive support include a cylindrical shape, a belt shape and a sheet shape. Among the supports, the cylindrical support is preferable. In addition, the surface of the electroconductive support may be subjected to electrochemical treatment such as anodic oxidation, blast treatment, cutting treatment and the like.

As a material of the electroconductive support, a metal, a resin, glass and the like are preferable.

Examples of the metal include aluminum, iron, nickel, copper, gold, stainless steel, and alloys thereof. Among the metals, an aluminum support using aluminum is preferable.

In addition, the electroconductivity may be imparted to the resin or the glass by treatment such as mixing of or coating with an electroconductive material.

<Electroconductive Layer>

In the present disclosure, an electroconductive layer may be provided on the support. By providing the electroconductive layer, scratches and concave and convex on the surface of the support can be concealed and the reflection of light on the surface of the support can be controlled.

It is preferable that the electroconductive layer contain an electroconductive particle and a resin.

Examples of a material of the electroconductive particle include a metal oxide, a metal and carbon black.

Examples of the metal oxide include zinc oxide, aluminum oxide, indium oxide, silicon oxide, zirconium oxide, tin oxide, titanium oxide, magnesium oxide, antimony oxide and bismuth oxide. Examples of the metal include aluminum, nickel, iron, nichrome, copper, zinc and silver.

Among the materials, it is preferable to use a metal oxide as the electroconductive particle, and in particular, it is more preferable to use titanium oxide, tin oxide or zinc oxide.

When the metal oxide is used as the electroconductive particle, the surface of the metal oxide may be treated with a silane coupling agent or the like, or the metal oxide may be doped with an element such as phosphorus or aluminum or an oxide thereof.

In addition, the electroconductive particle may have a layered structure having a core material particle and a covering layer with which the particle is covered. Examples of the core material particle include titanium oxide, barium sulfate and zinc oxide. Examples of the covering layer include a metal oxide such as tin oxide.

In addition, when the metal oxide is used as the electroconductive particle, it is preferable for the volume average particle diameter to be 1 nm or larger and 500 nm or smaller, and is more preferably to be 3 nm or larger and 400 nm or smaller.

Examples of the resin include a polyester resin, a polycarbonate resin, a polyvinyl acetal resin, an acrylic resin, a silicone resin, an epoxy resin, a melamine resin, a polyurethane resin, a phenol resin and an alkyd resin.

In addition, the electroconductive layer may further contain a concealing agent such as a silicone oil, a resin particle and titanium oxide.

It is preferable for the average film thickness of the electroconductive layer to be 1 μm or larger and 50 μm or smaller, and is particularly preferable to be 3 μm or larger and 40 μm or smaller.

The electroconductive layer can be formed by preparing a coating liquid for the electroconductive layer, which contains each of the above materials and a solvent, forming a coating film of the coating liquid, and drying the coating film. Examples of the solvent to be used for the coating liquid include an alcohol-based solvent, a sulfoxide-based solvent, a ketone-based solvent, an ether-based solvent, an ester-based solvent and an aromatic hydrocarbon-based solvent. Examples of a dispersion method for dispersing the electroconductive particles in the coating liquid for the electroconductive layer include a method using a paint shaker, a sand mill, a ball mill, or a liquid collision type high speed dispersion machine.

<Undercoat Layer>

In the present disclosure, an undercoat layer may be provided on the support or the electroconductive layer. By providing the undercoat layer, an adhesion function between layers can be enhanced and a charge injection inhibition function can be imparted.

It is preferable that the undercoat layer contain a resin. In addition, the undercoat layer may be formed as a cured film by polymerization of a composition which contains a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamic acid resin, a polyimide resin, a polyamide imide resin and a cellulose resin.

Examples of the polymerizable functional group which the monomer having the polymerizable functional group has include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group and a carbon-carbon double bond group.

In addition, the undercoat layer may further contain an electron transport substance, a metal oxide, a metal, an electroconductive polymer and the like, for the purpose of enhancing the electric characteristics. Among the materials, it is preferable to use the electron transport substance and the metal oxide.

Examples of the electron transport substance include a quinone compound, an imide compound, a benzimidazole compound, a cyclopentadienylidene compound, a fluorenone compound, a xanthone compound, a benzophenone compound, a cyano vinyl compound, a halogenated aryl compound, a silole compound and a boron-containing compound. The undercoat layer may be formed as a cured film by using an electron transport substance having a polymerizable functional group as the electron transport substance, and copolymerizing the electron transport substance with a monomer having the above polymerizable functional group.

Examples of the metal oxide include indium tin oxide, tin oxide, indium oxide, titanium oxide, zinc oxide, aluminum oxide and silicon dioxide. Examples of the metal include gold, silver and aluminum.

In addition, the undercoat layer may also further contain an additive.

It is preferable for the average film thickness of the undercoat layer to be 0.1 μm or larger and 50 μm or smaller, is more preferable to be 0.2 μm or larger and 40 μm or smaller, and is particularly preferable to be 0.3 μm or larger and 30 μm or smaller.

The undercoat layer can be formed by preparing a coating liquid for the undercoat layer which contains each of the above materials and a solvent, forming a coating film of the coating liquid on the support or the electroconductive layer, and drying and/or curing the coating film. Examples of the solvent to be used for the coating liquid include an alcohol-based solvent, a ketone-based solvent, an ether-based solvent, an ester-based solvent and an aromatic hydrocarbon-based solvent.

<Photosensitive Layer>

The photosensitive layer of the electrophotographic photosensitive member is mainly classified into (1) a multilayer type photosensitive layer, and (2) a monolayer type photosensitive layer. The multilayer type photosensitive layer (1) includes a charge generation layer containing a charge generation substance, and a charge transport layer containing a charge transport substance. The monolayer type photosensitive layer (2) contains both of the charge generation substance and the charge transport substance.

(1) Multilayer Type Photosensitive Layer

The multilayer type photosensitive layer includes the charge generation layer and the charge transport layer.

(1-1) Charge Generation Layer

It is preferable that the charge generation layer contain the charge generation substance and a resin.

Examples of the charge generation substance include an azo pigment, a perylene pigment, a polycyclic quinone pigment, an indigo pigment and a phthalocyanine pigment. Among the pigments, the azo pigment and the phthalocyanine pigment are preferable. Among the phthalocyanine pigments, oxytitanium phthalocyanine pigment, chlorogallium phthalocyanine pigment and hydroxygallium phthalocyanine pigment are preferable.

It is preferable for a content of the charge generation substance in the charge generation layer to be 40% by mass or more and 85% by mass or less, and is more preferable to be 60% by mass or more and 80% by mass or less, with respect to a total mass of the charge generation layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin and a polyvinyl chloride resin. Among the resins, the polyvinyl butyral resin is more preferable.

In addition, the charge generation layer may further contain additives such as an antioxidizing agent and an ultraviolet absorbing agent. Specific additives include a hindered phenol compound, a hindered amine compound, a sulfur compound, a phosphorus compound and a benzophenone compound.

It is preferable for the average film thickness of the charge generation layer to be 0.1 μm or larger and 1 μm or smaller, and is more preferable to be 0.15 μm or larger and 0.4 μm or smaller.

The charge generation layer can be formed by preparing a coating liquid for the charge generation layer, which contains each of the above materials and a solvent, forming a coating film of the coating liquid on the undercoat layer, and drying the coating film. Examples of the solvent to be used for the coating liquid include an alcohol-based solvent, a sulfoxide-based solvent, a ketone-based solvent, an ether-based solvent, an ester-based solvent and an aromatic hydrocarbon-based solvent.

(1-2) Charge Transport Layer

It is preferable that the charge transport layer contain a charge transport substance and a resin.

Examples of the charge transport substances include a polycyclic aromatic compound, a heterocyclic compound, a hydrazone compound, a styryl compound, an enamine compound, a benzidine compound, a triarylamine compound, and resins having a group derived from these substances.

A content of the charge transport substance in the charge transport layer is preferably 25% by mass or more and 70% by mass or less, and is more preferably 30% by mass or more and 55% by mass or less, with respect to a total mass of the charge transport layer.

Examples of the resin include a polyester resin, a polycarbonate resin, an acrylic resin and a polystyrene resin. Among the resins, the polycarbonate resin and the polyester resin are preferable. In the polyester resins, a polyarylate resin is particularly preferable.

A content ratio (mass ratio) between the charge transport substance and the resin is preferably 4:10 to 20:10, and is more preferably 5:10 to 12:10.

In addition, the charge transport layer may contain additives such as an antioxidizing agent, an ultraviolet absorbing agent, a plasticizing agent, a leveling agent, a slipperiness imparting agent and an abrasion resistance improver. The specific additives include a hindered phenol compound, a hindered amine compound, a sulfur compound, a phosphorus compound, a benzophenone compound, a siloxane modified resin, silicone oil, a fluorocarbon resin particle, a polystyrene resin particle, a polyethylene resin particle, a silica particle, an alumina particle and a boron nitride particle.

It is preferable for the average film thickness of the charge transport layer to be 5 μm or larger and 50 μm or smaller, is more preferable to be 8 μm or larger and 40 μm or smaller, and is particularly preferable to be 10 μm or larger and 30 μm or smaller.

The charge transport layer can be formed by preparing a coating liquid for the charge transport layer, which contains each of the above materials and a solvent, forming a coating film of the coating liquid on the charge generation layer, and drying the coating film. Examples of the solvent to be used for the coating liquid include an alcohol-based solvent, a ketone-based solvent, an ether-based solvent, an ester-based solvent and an aromatic hydrocarbon-based solvent. Among the solvents, the ether-based solvent or the aromatic hydrocarbon-based solvent is preferable.

(2) Monolayer Type Photosensitive Layer

The monolayer type photosensitive layer can be formed by preparing a coating liquid for the photosensitive layer, which contains a charge generation substance, a charge transport substance, a resin and a solvent, forming the coating film of the coating liquid on the support, the electroconductive layer or the undercoat layer, and drying the coating film. The charge generation substance, the charge transport substance and the resin are the same as the examples of the materials in the above "(1) multilayer type photosensitive layer".

<Surface Layer>

In the present disclosure, in the case of the multilayer type photosensitive layer, a surface layer may be provided on the charge transport layer, or in the case of a monolayer type photosensitive layer, a surface layer may be provided on the photosensitive layer. By providing the surface layer, durability can be improved.

The surface layer in the present disclosure includes a cured product of a composition of: a charge transporting compound having a chain polymerizable functional group selected from the group consisting of chain polymerizable functional groups represented by Formulas (1) to (4); a polymer having a structural unit represented by Formula (5) and a structural unit represented by Formula (6), and having a weight average molecular weight of 60,000 or more and 129,000 or less; and a polytetrafluoroethylene particle, wherein a number-average particle diameter of primary particles of the polytetrafluoroethylene particle is 150 nm or larger and 195 nm or smaller, an abundance ratio of a polytetrafluoroethylene particle having a primary particle diameter of 150 nm or smaller among the polytetrafluoroethylene particles is 10% by number or more, and an abundance ratio of a polytetrafluoroethylene particle having a primary particle diameter of 250 nm or larger is 5% by number or less.

In addition, the surface layer may be formed also as a cured film by the polymerization of a composition which contains a monomer having a polymerizable functional group. Examples of a reaction at this time include a thermal polymerization reaction, a photopolymerization reaction, and a radiation-induced polymerization reaction. Examples of the polymerizable functional group which the monomer having a polymerizable functional group has include an acryloyloxy group and a methacryloyloxy group. As a monomer having the polymerizable functional group, a material having charge transport capability may be used.

The surface layer may contain additives such as an antioxidizing agent, an ultraviolet absorbing agent, a plasticizing agent, a leveling agent, a slipperiness imparting agent and an abrasion resistance improver. The specific additives include a hindered phenol compound, a hindered amine compound, a sulfur compound, a phosphorus compound, a benzophenone compound, a siloxane modified resin, silicone oil, a fluorocarbon resin particle, a polystyrene resin particle, a polyethylene resin particle, a silica particle, an alumina particle and a boron nitride particle.

Furthermore, the charge transport substance can be added. Examples of the charge transport substance include a polycyclic aromatic compound, a heterocyclic compound, a hydrazone compound, a styryl compound, an enamine compound, a benzidine compound, a triarylamine compound, and resins having a group derived from these substances. Among the substances, the triarylamine compound and the benzidine compound are preferable.

It is preferable for the average film thickness of the surface layer to be 0.5 μm or larger and 10 μm or smaller, and is more preferable to be 1 μm or larger and 7 μm or smaller.

The surface layer can be formed by preparing a coating liquid for the surface layer which contains each of the above materials and a solvent, forming a coating film of the coating liquid on the photosensitive layer, and drying and/or curing the coating film. Examples of the solvent to be used for the coating liquid include an alcohol-based solvent, a ketone-based solvent, an ether-based solvent, a sulfoxide-based solvent, an ester-based solvent, an aliphatic halogenated hydrocarbon-based solvent and an aromatic hydrocarbon-based solvent. The alcohol-based solvent is preferable, from the viewpoint that the photosensitive layer of the lower layer is not dissolved.

Examples of a unit for curing the coating film of the coating liquid for the surface layer include methods of curing the coating film by heat, ultraviolet light and/or an electron beam. In order to improve the strength of the surface layer of the electrophotographic photosensitive member and the durability of the electrophotographic photosensitive member, it is preferable to cure the coating film by use of ultraviolet light or an electron beam.

In the case of irradiation with the electron beam, examples of an accelerator include scanning type, electric curtain type, broad beam type, pulse type and laminar type accelerators. It is preferable that the acceleration voltage of the electron beam be 120 kV or lower, from the viewpoint that degradation of the material characteristics due to the electron beam can be suppressed without any loss of polymerization efficiency. In addition, the dose of the electron beam absorbed on the surface of the coating film of the coating liquid for the surface layer is preferably 5 kGy or more and 50 kGy or less, and is more preferably 1 kGy or more and 10 kGy or less.

In addition, when the above composition is cured (polymerized) by use of the electron beam, it is preferable to irradiate the composition with the electron beam under an inert gas atmosphere, and then heat the composition under an inert gas atmosphere, from the viewpoint of suppressing a polymerization inhibition action caused by oxygen. Examples of the inert gas include nitrogen, argon and helium.

In addition, it is preferable to irradiate the composition with ultraviolet light or the electron beam, and then heat the electrophotographic photosensitive member to 100° C. or higher and 140° C. or lower. Thereby, a protective layer which has further high durability and reduces image failures can be obtained.

The surface of the surface layer may be subjected to surface treatment with the use of an abrasive sheet, a shape transfer mold member, glass beads, zirconia beads or the like. In addition, concave and convex may be formed on the surface with the use of a constituent material of the coating liquid. It is more preferable to provide concaves or convexes on the surface layer of the electrophotographic photosensitive member, for the purpose of more stabilizing a behavior of a cleaning unit (cleaning blade) which is brought into contact with the electrophotographic photosensitive member.

The above concaves or convexes may be formed on the whole area of the surface of the electrophotographic photosensitive member, or may be formed on one part of the surface of the electrophotographic photosensitive member. In the case where the concaves or the convexes are formed on the one part of the surface of the electrophotographic photosensitive member, it is preferable that the concaves or the convexes be formed at least on the whole area of a contact region with the cleaning unit (cleaning blade).

In the case where the concaves or the convexes are formed, the concaves or the convexes can be formed on the surface of the electrophotographic photosensitive member, by operations of: bringing a mold having the convexes corresponding to the concaves or the concaves corresponding to the convexes, into pressure contact with the surface of the electrophotographic photosensitive member; and transferring the shapes to the surface.

[Process Cartridge and Electrophotographic Apparatus]

A process cartridge of the present disclosure includes: integrally supporting the electrophotographic photosensitive member described above, and at least one unit selected from the group consisting of a charging unit, a developing unit and a cleaning unit; and being detachably attachable to a main body of an electrophotographic apparatus.

In addition, an electrophotographic apparatus of the present disclosure includes: the electrophotographic photosensitive member described above; a charging unit; an exposure unit; a developing unit; and a transfer unit.

Figure 2:
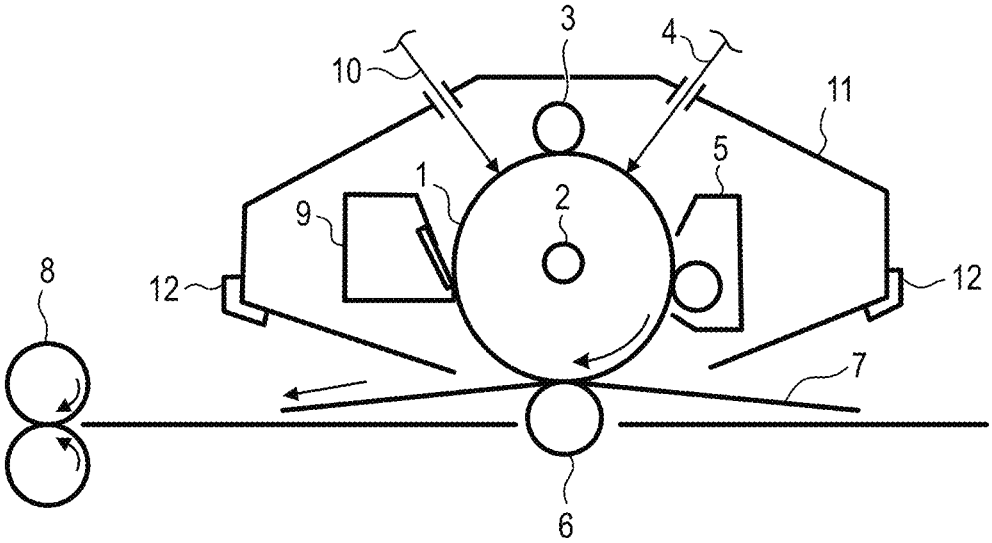
FIG. 2 illustrates a view illustrating one example of a schematic configuration of an electrophotographic apparatus provided with a process cartridge that includes an electrophotographic photosensitive member of the present disclosure.

FIG. 2 illustrates an example of a schematic configuration of the electrophotographic apparatus that has the process cartridge provided with the electrophotographic photosensitive member.

Reference Numeral 1 represents a cylinder-shaped electrophotographic photosensitive member, and the electrophotographic photosensitive member is rotary-driven around a shaft 2 in an arrow direction at a predetermined circumferential velocity. The surface of the electrophotographic photosensitive member 1 is electrically charged to a predetermined positive or negative potential by a charging unit 3. For information, in FIG. 2, a roller charging system by a roller type charging member is illustrated, but a charging system such as a corona charging system, a proximity charging system or an injection charging system may also be adopted. The surface of the electrically charged electrophotographic photosensitive member 1 is irradiated with exposure light 4 emitted from an exposure unit (not illustrated), and an electrostatic latent image corresponding to objective image information is formed on the surface. The electrostatic latent image formed on the surface of the electrophotographic photosensitive member 1 is developed by a toner accommodated in a developing unit 5, and a toner image is formed on the surface of the electrophotographic photosensitive member 1. The toner image formed on the surface of the electrophotographic photosensitive member 1 is transferred onto a transfer material 7 by a transfer unit 6. The transfer material 7 onto which the toner image has been transferred is conveyed to a fixing unit 8, is subjected to fixing treatment of the toner image, and is printed out to the outside of the electrophotographic apparatus. The electrophotographic apparatus may have a cleaning unit 9 for removing an adherent such as a toner remaining on the surface of the electrophotographic photosensitive member 1 after transferring. Alternatively, the cleaning unit may not be separately provided, but a so-called cleaner-less system may be used that removes the above adherent by a developing unit or the like. The electrophotographic apparatus may have a neutralization mechanism that subjects the surface of the electrophotographic photosensitive member 1 to neutralization treatment by pre-exposure light 10 emitted from a pre-exposure unit (not illustrated). In addition, a guiding unit 12 such as a rail may also be provided in order to detachably attach the process cartridge 11 of the present disclosure to a main body of the electrophotographic apparatus.

The electrophotographic photosensitive member of the present disclosure can be used in a laser beam printer, an LED printer, a copying machine, a facsimile, a combined machine thereof and the like.

EXAMPLES

The present disclosure will be described below in more detail with reference to Examples and Comparative Examples. The present disclosure is not limited to the following Examples at all, as long as the present disclosure does not exceed the gist thereof. Herein, the term "part(s)" in the following description of Examples is on a mass basis, unless otherwise particularly noted.

In Examples, the number average molecular weight of the polytetrafluoroethylene particles was calculated by the following measurement method.

(Measurement of Number Average Molecular Weight of Polytetrafluoroethylene Particles)

The molecular weight was calculated from a result of the measurement of differential scanning calorimetry (which will be hereinafter abbreviated as "DSC"). The measurement of the DSC was performed with the use of DSC 822e manufactured by METTLER TOLEDO under a nitrogen atmosphere. The polytetrafluoroethylene particles were placed in an aluminum sample pan with 40 μl, and were heated from 25° C. to 350° C. at a heating rate of 16° C./minute. Next, the temperature was maintained at 350° C. for 10 minutes, and thereafter lowered to 280° C. at a temperature lowering rate of 16° C./minute. The crystallization heat ΔHc was determined from a peak at the time of temperature lowering.

The number average molecular weight Mn was determined from the crystallization heat ΔHc according to Expression (a-1).

$$Mn=2.1\times10^{10}\times\Delta Hc^{-5.16} \quad \text{Expression (a-1)}$$

(Measurement of Number-Average Particle Diameter and Abundance Ratio of Primary Particles of Polytetrafluoroethylene Particle)

The number-average particle diameter and abundance ratio of primary particles of the polytetrafluoroethylene particle were measured with the use of a field emission scanning electron microscope (FE-SEM). The polytetrafluoroethylene particles were attached to a commercially available carbon electroconductive tape, the PTFE particles which were not attached to the electroconductive tape were removed by compressed air, and platinum vapor deposition was performed. The vapor-deposited polytetrafluoroethylene particles were observed with the use of FE-SEM (S-4700) manufactured by Hitachi High-Tech Corporation.

The Feret's diameters of primary particles corresponding to 200 particles were determined from the obtained image, with the use of ImageJ (open source software produced by National Institutes of Health (NIH)), and the number-average particle diameter and abundance ratio of the primary particles were calculated.

<Preparation of Electrophotographic Photosensitive Member>

Example 1

An aluminum cylinder with a cylindrical shape having a diameter of 30 mm, a length of 357.5 mm and a thickness of 1 mm was adopted as an electroconductive support.

Next, 100 parts of a zinc oxide particle (specific surface area: 19 $m^2/g$, powder resistivity: $4.7\times10^6$ Ω·cm) as a metal oxide and 500 parts of toluene were stirred and mixed; and 0.8 parts of a silane coupling agent (compound name: N-2-(aminoethyl)-3-aminopropylmethyldimethoxysilane, trade name: KBM602, produced by Shin-Etsu Chemical Co., Ltd.) were added thereto, and the mixture was stirred for 6 hours. After that, toluene was distilled off under reduced pressure, and the resultant product was heated and dried at 130° C. for 6 hours, to obtain a surface-treated zinc oxide particle.

Next, 15 parts of a butyral resin (trade name: BM-1, produced by Sekisui Chemical Co., Ltd.) and 15 parts of a blocked isocyanate (trade name: Sumidur 3175, produced by Sumitomo Covestro Urethane Co., Ltd.) were dissolved in a mixed solution of 73.5 parts of methyl ethyl ketone and 73.5 parts of 1-butanol. To this solution, 80.8 parts of the surface-treated zinc oxide particle and 0.81 parts of a compound indicated by 2,3,4-trihydroxybenzophenone (produced by Tokyo Chemical Industry Co., Ltd.) were added. The mixture was dispersed in a sand mill apparatus which used glass beads having a diameter of 0.8 mm, under an atmosphere of 23±3° C. for 3 hours. After the dispersion, 0.01 parts of silicone oil (trade name: SH28PA, produced by Dow Corning Toray Co., Ltd.), and 5.6 parts of a cross-linked polymethylmethacrylate (PMMA) particle (trade name: Techpolymer SSX-103, produced by Sekisui Kasei Co., Ltd., and average primary particle size: 3.0 μm) were added thereto, the mixture was stirred, and a coating liquid for the undercoat layer was prepared.

The above support was dip-coated with this coating liquid for the undercoat layer, and the obtained coating film was dried at 160° C. for 30 minutes, to form an undercoat layer having a film thickness of 18 μm.

10 parts of hydroxygallium phthalocyanine with a crystal form having peaks at positions of 7.5° and 28.4° of 20±0.2° in a chart obtained from CuKα characteristic X-ray diffraction, 5 parts of a polyvinyl butyral resin (trade name: S-REC BX-1; produced by Sekisui Chemical Co., Ltd.), and 0.04 parts of a compound represented by the following structural Formula (A) were provided. These substances were added to 200 parts of cyclohexanone, and were dispersed for 6 hours in a sand mill apparatus which used glass beads having a diameter of 0.9 mm. To the dispersion liquid, 150 parts of cyclohexanone and 350 parts of ethyl acetate were further added for dilution, to obtain a coating liquid for a charge generation layer. The undercoat layer was dip-coated with the obtained coating liquid, and the obtained coating film was dried at 95° C. for 10 minutes, to form a charge generation layer having a film thickness of 0.20 μm.

(A)

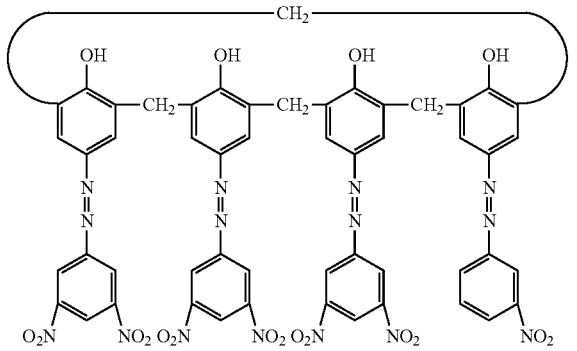

A coating liquid for the charge transport layer was prepared by an operation of dissolving 30 parts of a compound represented by the following Formula (B), 60 parts of a compound represented by the following Formula (C), 10 parts of a compound represented by the following Formula (D), 100 parts of a polycarbonate resin (trade name: Iupilon Z400, produced by Mitsubishi Engineering Plastics Corporation, bisphenol Z type), and 0.02 parts of polycarbonate (viscosity-average molecular weight Mv: 20000) represented by the following Formula (E), into solvents of 270 parts of mixed xylene, 275 parts of dimethoxymethane, and 250 parts of methyl benzoate. The charge generation layer was dip-coated with this coating liquid for the charge transport layer to have a coating film formed thereon, and the obtained coating film was dried at 100° C. for 30 minutes, to form a charge transport layer having a film thickness of 18 μm.

(B)

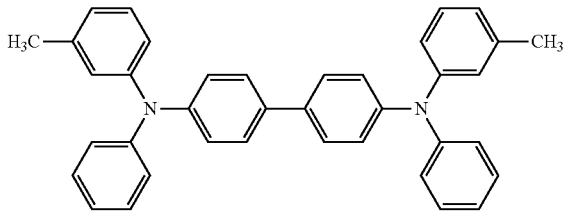

(C)

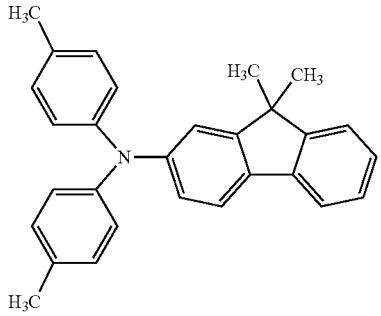

(D)

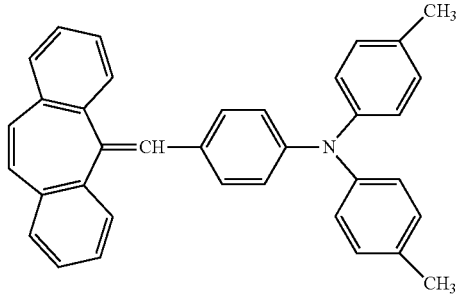

(E)

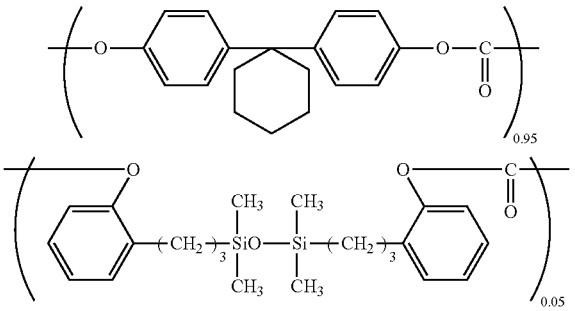

1.38 parts of a polymer having a structural unit represented by Formula (5-5) and a structural unit represented by the following Formula (6-1) (copolymerization ratio: the following Formula (5-5)/the following Formula (6-1)=1/1 (molar ratio), and weight average molecular weight: 110,000), 25.4 parts of 1,1,2,2,3,3,4-heptafluorocyclopentane, and 33.6 parts of 1-propanol were mixed and dissolved. After that, 19.7 parts of polytetrafluoroethylene particles were added (the number-average particle diameter of primary particles, abundance ratio of particles having a primary particle diameter of 150 nm or smaller, abundance ratio of particles having a primary particle diameter of 250 nm or larger, and number average molecular weight are shown in Table 2). Next, the mixture was passed through a high-pressure dispersion machine (trade name: Microfluidizer M 110EH, manufactured by Microfluidics Corporation in U.S.A.), to obtain a dispersion liquid.

(6-1)

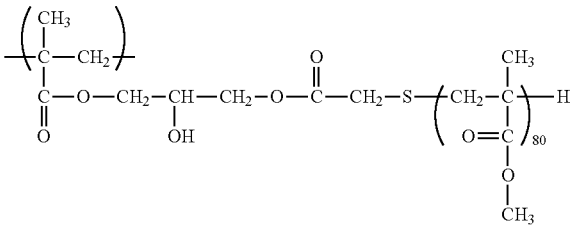

Next, 44.6 parts of a compound represented by Formula (1-6), 0.45 parts of a compound represented by Formula (9-1), 22.5 parts of 1-propanol and 21.0 parts of 1,1,2,2,3,3,4-heptafluorocyclopentane were mixed and dissolved to obtain a preparation liquid.

To the preparation liquid, 80.0 parts of the dispersion liquid was added; and the mixture was stirred and mixed, then was filtered through a polytetrafluoroethylene filter (trade name: PF-040, produced by Advantec Toyo Kaisha, Ltd.), and a coating liquid for the surface layer was prepared. The charge transport layer was dip-coated with this coating liquid, and the obtained coating film was subjected to heat treatment at 50° C. for 5 minutes.

After the heat treatment, the coating film was irradiated with an electron beam in a nitrogen atmosphere for 1.6 seconds under conditions of accelerating voltage of 70 kV and absorbed dose of 5000 Gy, while the cylinder was rotated; and was cured. After that, the coating film was heated for 25 seconds under a nitrogen atmosphere under such conditions that the temperature of the coating film became 130° C. In addition, an oxygen concentration in a period between the irradiation with the electron beam and the heat treatment for 25 seconds was 18 ppm. Next, in the air, the coating film was subjected to heat treatment for 15 minutes under the condition that the coating film became 110° C., to form a surface layer having a film thickness of 4.8 μm.

In this way, an electrophotographic photosensitive member of Example 1 having the undercoat layer, the charge generation layer, the charge transport layer and the surface layer on the electroconductive support, in this order, was produced.

Examples 2 and 3

Electrophotographic photosensitive members of Examples 2 and 3 were produced in the same manner as in Example 1, except that coating liquids for the surface layers were prepared by changing: the type and content of the charge transporting compound having a chain polymerizable functional group; the type and weight average molecular weight of the polymer having the structural unit represented by Formula (5) and the structural unit represented by Formula (6); and the number-average particle diameter of the primary particles of the polytetrafluoroethylene particle, the abundance ratio of the polytetrafluoroethylene particles having a primary particle diameter of 150 nm or smaller, the abundance ratio of the polytetrafluoroethylene particles having a primary particle diameter of 250 nm or larger, and the content in the surface layer, in Example 1, as are shown in Tables 1 and 2.

Example 4

The charge generation layer, the charge transport layer and the surface layer were formed in the same manner as in Example 1, except that the undercoat layer of Example 1 was changed to the following electroconductive layer and undercoat layer, and an electrophotographic photosensitive member of Example 4 was produced.

The materials were charged into a ball mill that were 60 parts of a barium sulfate particle (trade name: Passtran PC1, produced by Mitsui Mining & Smelting Co., Ltd.) which was coated with tin oxide, 15 parts of a titanium oxide particle (trade name: TITANIX JR, produced by Tayca Corporation), 43 parts of a resol type phenol resin (trade name: Phenolite J-325, produced by DIC Corporation, solid content 70 mass %), 0.015 parts of silicone oil (trade name: SH28PA, produced by Dow Corning Toray Co., Ltd.), 3.6 parts of a silicone resin particle (trade name: Tospearl 120, produced by Momentive Performance Materials Japan Co., Ltd.), 50 parts of 2-methoxy-1-propanol, and 50 parts of methanol, and were subjected to dispersion treatment for 20 hours; and thereby a coating liquid for an electroconductive layer was prepared. The electroconductive support was dip-coated with this coating liquid for the electroconductive layer, and the obtained coating film was heated at 140° C. for one hour to be cured, to form an electroconductive layer having a film thickness of 15 μm.

Next, 10 parts of a copolymer nylon (trade name: AMILAN CM8000, produced by Toray Industries, Inc.) and 30 parts of methoxymethylated 6-nylon resin (trade name: Toresin EF-30T, produced by Nagase ChemteX Corporation) were dissolved in a mixed solvent of 400 parts of methanol and 200 parts of n-butanol; and thereby, a coating liquid for the undercoat layer was prepared. The electroconductive layer was dip-coated with this coating liquid for the undercoat layer, and the obtained coating film was dried at 100° C. for 30 minutes, to form the undercoat layer having a film thickness of 0.45 μm.

The above electroconductive layer was dip-coated with this coating liquid for the undercoat layer, the obtained coating film was dried at 160° C. for 30 minutes, to form an undercoat layer having a film thickness of 2.0 μm.

Example 5

The undercoat layer, the charge generation layer and the charge transport layer were formed in the same manner as in Example 1, except that the surface layer was changed to the following, and an electrophotographic photosensitive member of Example 5 was produced.

1.38 parts of a polymer having a structural unit represented by Formula (5-1) and a structural unit represented by Formula (6-1) (copolymerization ratio: Formula (5-1)/Formula (6-1)=1/1 (molar ratio), and weight average molecular weight: 120,000), 25.4 parts of 1,1,2,2,3,3,4-heptafluorocyclopentane, and 33.6 parts of 1-propanol were mixed and dissolved. After that, 19.7 parts of polytetrafluoroethylene particles were added (the number-average particle diameter of primary particles, abundance ratio of particles having a primary particle diameter of 150 nm or smaller, abundance ratio of particles having a primary particle diameter of 250 nm or larger, and number average molecular weight are shown in Table 2). Next, the mixture was passed through a high-pressure dispersion machine (trade name: Microfluidizer M 110EH, manufactured by Microfluidics Corporation in U.S.A.), to obtain a dispersion liquid.

Next, 33.8 parts of the charge transporting compound represented by Formula (1-6), 0.34 parts of the charge transporting compound represented by Formula (9-1), 10.6 parts of tris (2-hydroxy ethyl) isocyanurate triacrylate (Aronix M-315, produced by Toagosei Co., Ltd.)), 1.36 parts of vinyl laurate, 0.16 parts of a silicone-modified acrylic compound (Symac US-270, produced by Toagosei Co., Ltd.), 10.7 parts of 1,1,2,2,3,3,4,-heptafluorocyclopentane, and 26.8 parts of 1-propanol were mixed and dissolved to obtain a preparation liquid.

To the preparation liquid, 80.0 parts of the dispersion liquid was added; and the mixture was stirred and mixed, then was filtered through a polytetrafluoroethylene filter (trade name: PF-040, produced by Advantec Toyo Kaisha, Ltd.), and a coating liquid for the surface layer was prepared. The charge transport layer was dip-coated with this coating liquid, and the obtained coating film was subjected to heat treatment at 40° C. for 5 minutes.

After the heat treatment, the coating film was irradiated with an electron beam in a nitrogen atmosphere for 1.6 seconds under conditions of accelerating voltage of 70 kV and absorbed dose of 5000 Gy, while the cylinder was rotated; and was cured. After that, the coating film was heated for 25 seconds under a nitrogen atmosphere, under such conditions that the temperature of the coating film became 130° C. In addition, an oxygen concentration in a period between the irradiation with the electron beam and the heat treatment for 25 seconds was 18 ppm. Next, in the air, the coating film was subjected to heat treatment for 15 minutes under the conditions that the coating film became 110° C., to form a surface layer having a film thickness of 4.8 μm.

Examples 6 to 10

Electrophotographic photosensitive members of Examples 6 to 10 were produced in the same manner as in Example 1, except that coating liquids for the surface layers were prepared by changing: a type and content of the charge transporting compound having a chain polymerizable functional group; a type and weight average molecular weight of a polymer having the structural unit represented by Formula (5) and a structural unit represented by Formula (6); and a number-average particle diameter of primary particles of the polytetrafluoroethylene particle, an abundance ratio of polytetrafluoroethylene particles having a primary particle diameter of 150 nm or smaller, an abundance ratio of polytetrafluoroethylene particles having a primary particle diameter of 250 nm or larger, and a content in the surface layer, as are shown in Tables 1 and 2.

Example 11

An electrophotographic photosensitive member of Example 11 was produced in the same manner as in Example 5 except that coating liquids for the surface layers were prepared by changing: the type and content of the charge transporting compound having the chain polymerizable functional group; the type and weight average molecular weight of the polymer having the structural unit represented by Formula (5) and the structural unit represented by Formula (6); and the number-average particle diameter of the primary particles of the polytetrafluoroethylene particle, the abundance ratio of polytetrafluoroethylene particles having a primary particle diameter of 150 nm or smaller, the abundance ratio of the polytetrafluoroethylene particles having a primary particle diameter of 250 nm or larger, and the content in the surface layer, in Example 5, as are shown in Tables 1 and 2.

Example 12

The undercoat layer, the charge generation layer and the charge transport layer were formed in the same manner as in Example 1, except that the surface layer was changed to the following; and an electrophotographic photosensitive member was produced.

1.38 parts of the polymer having a structural unit represented by Formula (5-1) and a structural unit represented by Formula (6-1) (copolymerization ratio: Formula (5-1)/Formula (6-1)=1/1 (molar ratio), and weight average molecular weight: 110,000), 25.4 parts of 1,1,2,2,3,3,4-heptafluorocyclopentane, and 33.6 parts of 1-propanol were mixed and dissolved. After that, 19.7 parts of polytetrafluoroethylene particles were added (the number-average particle diameter of primary particles, abundance ratio of particles having a primary particle diameter of 150 nm or smaller, abundance ratio of particles having a primary particle diameter of 250 nm or larger, and number average molecular weight are shown in Table 2). Next, the mixture was passed through a high-pressure dispersion machine (trade name: Microfluidizer M 110EH, manufactured by Microfluidics Corporation in U.S.A.), to obtain a dispersion liquid.

Next, 45.0 parts of a compound represented by Formula (1-15), and 22.5 parts of 1-propanol and 21.0 parts of 1,1,2,2,3,3,4-heptafluorocyclopentane were mixed and dissolved to obtain a preparation liquid.

To the preparation liquid, 80.0 parts of the dispersion liquid and 0.90 parts of VE-73 (produced by Fujifilm Wako Pure Chemical Corporation) of the polymerization initiator were added, the mixture was stirred and mixed at room temperature for 12 hours, and a coating liquid for the surface layer was prepared.

Next, the charge transport layer was dip-coated with the obtained coating liquid for the surface layer, in advance. The obtained coating film was subjected to heat treatment at 160° C. for 60 minutes, in a state in which an oxygen concentration is 100 ppm or lower, to form a surface layer having a film thickness of 5.0 μm.

In this way, an electrophotographic photosensitive member having the undercoat layer, the charge generation layer, the charge transport layer and the surface layer on the electroconductive support, in this order, was produced.

Example 13

An electrophotographic photosensitive member of Example 13 was produced in the same manner as in Example 12 except that coating liquids for the surface layers were prepared by changing: the type and content of the charge transporting compound having the chain polymerizable functional group; the type and weight average molecular weight of the polymer having the structural unit represented by Formula (5) and the structural unit represented by Formula (6); and the number-average particle diameter of the primary particles of the polytetrafluoroethylene particle, the abundance ratio of polytetrafluoroethylene particles having a primary particle diameter of 150 nm or smaller, the abundance ratio of polytetrafluoroethylene particles having a primary particle diameter of 250 nm or larger, and the content in the surface layer, in Example 12, as are shown in Tables 1 and 2.

Examples 14 to 23

Electrophotographic photosensitive members of Examples 14 to 23 were produced in the same manner as in Example 1, except that coating liquids for the surface layers were prepared by changing: the type and content of the charge transporting compound having the chain polymerizable functional group; the type and weight average molecular weight of the polymer having the structural unit represented by Formula (5) and the structural unit represented by Formula (6); and the number-average particle diameter of the primary particles of the polytetrafluoroethylene particle, the abundance ratio of the polytetrafluoroethylene particles having a primary particle diameter of 150 nm or smaller, the abundance ratio of polytetrafluoroethylene particles having a primary particle diameter of 250 nm or larger, and the content in the surface layer, in Example 1, as are shown in Tables 1 and 2.

Comparative Examples 1 to 5

Electrophotographic photosensitive members of Comparative Examples 1 to 5 were produced in the same manner as in Example 1, except that coating liquids for the surface layers were prepared by changing: the type and content of the charge transporting compound having the chain polymerizable functional group; the type and weight average molecular weight of the polymer having the structural unit represented by Formula (5) and the structural unit represented by Formula (6); and the number-average particle diameter of the primary particles of the polytetrafluoroethylene particle, the abundance ratio of the polytetrafluoroethylene particles having a primary particle diameter of 150 nm or smaller, the abundance ratio of the polytetrafluoroethylene particles having a primary particle diameter of 250 nm or larger, and the content in the surface layer, in Example 1, as are shown in Tables 1 and 2.

TABLE 1

| | Charge transporting compound having chain polymerizable functional group | | | | Polymer having structural units of Formula (5)/(6) | |
|---|---|---|---|---|---|---|
| | Charge transporting compounds having chain polymerizable functional groups of Formulas (1) to (3) | Mass parts | Charge transporting compound having chain polymerizable functional group of Formula (9) | Mass parts | Compound | Weight average molecular weight |
| Example 1 | (1-6) | 44.6 | (9-6) | 0.45 | (5-5)/(6-1) | 110,000 |
| Example 2 | (1-6) | 44.6 | (9-6) | 0.45 | (5-5)/(6-1) | 110,000 |
| Example 3 | (1-6) | 44.6 | (9-9) | 0.45 | (5-5)/(6-1) | 90,000 |
| Example 4 | (1-6) | 44.6 | (9-9) | 0.45 | (5-5)/(6-1) | 125,000 |
| Example 5 | (1-6) | 33.8 | (9-9) | 0.34 | (5-5)/(6-1) | 120,000 |
| Example 6 | (1-6) | 45.0 | — | — | (5-5)/(6-1) | 110,000 |
| Example 7 | (1-6) | 45.0 | — | — | (5-5)/(6-1) | 90,000 |
| Example 8 | (1-6) | 45.0 | — | — | (5-5)/(6-1) | 100,000 |
| Example 9 | (1-7) | 45.0 | — | — | (5-5)/(6-1) | 110,000 |
| Example 10 | (1-11) | 45.0 | — | — | (5-5)/(6-1) | 100,000 |
| Example 11 | (1-6) | 34.1 | — | — | (5-5)/(6-1) | 120,000 |
| Example 12 | (1-15) | 45.0 | — | — | (5-5)/(6-1) | 110,000 |
| Example 13 | (1-21) | 45.0 | — | — | (5-5)/(6-1) | 110,000 |
| Example 14 | (1-6) | 45.0 | — | — | (5-7)/(6-1) | 90,000 |
| Example 15 | (1-7) | 45.0 | — | — | (5-5)/(6-1) | 90,000 |
| Example 16 | (1-7) | 45.0 | — | — | (5-5)/(6-1) | 110,000 |
| Example 17 | (1-7) | 45.0 | — | — | (5-5)/(6-1) | 90,000 |
| Example 18 | (1-7) | 45.0 | — | — | (5-5)/(6-1) | 70,000 |
| Example 19 | (1-6) | 45.0 | — | — | (5-5)/(6-1) | 110,000 |
| Example 20 | (1-7) | 45.0 | — | — | (5-5)/(6-1) | 90,000 |
| Example 21 | (1-6) | 45.0 | — | — | (5-5)/(6-1) | 90,000 |
| Example 22 | (1-6) | 45.0 | — | — | (5-5)/(6-1) | 90,000 |
| Example 23 | (1-6) | 45.0 | — | — | (5-5)/(6-1) | 60,000 |
| Comparative Example 1 | (1-6) | 45.0 | — | — | (5-5)/(6-1) | 110,000 |
| Comparative Example 2 | (1-6) | 45.0 | — | — | (5-5)/(6-1) | 30,000 |
| Comparative Example 3 | (1-6) | 45.0 | — | — | (5-5)/(6-1) | 90,000 |
| Comparative Example 4 | (1-6) | 45.0 | — | — | (5-5)/(6-1) | 90,000 |
| Comparative Example 5 | (1-6) | 45.0 | — | — | (5-5)/(6-1) | 90,000 |

TABLE 2

| | Polytetrafluoroethylene particle | | | | |
|---|---|---|---|---|---|
| | Number-average particle diameter | Abundance ratio 150 nm or smaller | Abundance ratio 250 nm or larger | Number average molecular weight | Content in (mass %) surface layer |
| Example 1 | 180 nm | 20% | 2% | 16,000 | 29.8% |
| Example 2 | 180 nm | 20% | 2% | 20,000 | 29.8% |
| Example 3 | 185 nm | 20% | 3% | 13,000 | 29.8% |
| Example 4 | 180 nm | 20% | 2% | 16,000 | 29.8% |
| Example 5 | 185 nm | 20% | 3% | 16,000 | 29.5% |
| Example 6 | 180 nm | 20% | 2% | 16,000 | 29.8% |
| Example 7 | 185 nm | 20% | 3% | 12,000 | 29.8% |
| Example 8 | 180 nm | 20% | 2% | 20,000 | 29.8% |
| Example 9 | 180 nm | 20% | 2% | 16,000 | 29.8% |
| Example 10 | 180 nm | 20% | 2% | 12,000 | 29.8% |
| Example 11 | 185 nm | 20% | 3% | 16,000 | 29.5% |
| Example 12 | 180 nm | 20% | 2% | 16,000 | 29.8% |
| Example 13 | 180 nm | 20% | 2% | 16,000 | 29.8% |
| Example 14 | 180 nm | 20% | 2% | 21,000 | 29.8% |
| Example 15 | 180 nm | 20% | 2% | 11,000 | 20.0% |
| Example 16 | 180 nm | 20% | 2% | 21,000 | 40.0% |
| Example 17 | 170 nm | 32% | 2% | 11,000 | 20.0% |
| Example 18 | 190 nm | 10% | 5% | 11,000 | 20.0% |
| Example 19 | 190 nm | 20% | 2% | 21,000 | 15.0% |
| Example 20 | 170 nm | 32% | 2% | 21,000 | 15.0% |
| Example 21 | 170 nm | 32% | 2% | 21,000 | 45.0% |
| Example 22 | 150 nm | 60% | 0% | 11,000 | 15.0% |
| Example 23 | 195 nm | 10% | 5% | 11,000 | 15.0% |
| Comparative Example 1 | 200 nm | 0% | 15% | 25,000 | 29.8% |
| Comparative Example 2 | 200 nm | 0% | 15% | 25,000 | 15.0% |
| Comparative Example 3 | 200 nm | 10% | 5% | 20,000 | 29.8% |
| Comparative Example 4 | 130 nm | 70% | 0% | 20,000 | 29.8% |
| Comparative Example 5 | 190 nm | 0% | 10% | 20,000 | 30.0% |

[Evaluation]

An effect of suppressing image failures (streak-like image defect) in images output through the electrophotographic photosensitive members which were produced in Examples 1 to 23 and Comparative Examples 1 to 5 were evaluated in the following way.

(Image Evaluation)

The obtained electrophotographic photosensitive member was mounted on a black station of a modified machine of an electrophotographic apparatus (trade name: iR-ADVC5251) manufactured by Canon Inc., in an environment at a temperature of 35° C. and a humidity of 85% RH; and 180000 sheets of images having an image ratio of 1% were output. On the way of the output, also after 80000 sheets, 120000 sheets and 150000 sheets were output, a solid black image was output, and the image was evaluated. In addition, the drum cycle speed was set at 0.2 seconds by the modification of the apparatus.

In addition, the obtained electrophotographic photosensitive member was similarly mounted on the black station of the modified machine of the electrophotographic apparatus (trade name: iR-ADVC5251) manufactured by Canon Inc., also in an environment at a temperature of 15° C. and a humidity of 10% RH; and 180000 sheets of images having an image ratio of 1% were output. On the way of the output, a solid black image was output also after 80000 sheets, 120000 sheets and 150000 sheets were output, and the image was evaluated. In addition, the drum cycle speed was set at 0.2 seconds by the modification of the apparatus.

The effect of suppressing a streak-like image defect was evaluated about the obtained fourth image, according to the following evaluation ranks. Larger number of the rank corresponds to more satisfactory effect, and ranks 5, 4, and 3 were evaluated as having a satisfactory effect of suppressing the streak-like image defect.

Rank 4: Image defects are not observed in both environments of 35° C. and a humidity of 85% RH, and 15° C. and a humidity of 10% RH.

Rank 3: There are 1 point or 2 points in total of the streak-like image defect which has been generated in each environment of 35° C. and a humidity of 85% RH, and 15° C. and a humidity of 10% RH.

Rank 2: There are 3 points in total of the streak-like image defect which has been generated in each environment of 35° C. and a humidity of 85% RH, and 15° C. and a humidity of 10% RH.

Rank 1: There are 4 or more points in total of the streak-like image defect which has been generated in each environment of 35° C. and a humidity of 85% RH, and 15° C. and a humidity of 10% RH.

The evaluation results are shown in Table 3.

TABLE 3

| | Image evaluation | | | |
|---|---|---|---|---|
| | 75000 sheets | 100000 sheets | 125000 sheets | 150000 sheets |
| Example 1 | 4 | 4 | 4 | 4 |
| Example 2 | 4 | 4 | 4 | 4 |
| Example 3 | 4 | 4 | 4 | 4 |
| Example 4 | 4 | 4 | 4 | 4 |
| Example 5 | 4 | 4 | 4 | 4 |
| Example 6 | 4 | 4 | 4 | 3 |
| Example 7 | 4 | 4 | 4 | 3 |
| Example 8 | 4 | 4 | 4 | 3 |
| Example 9 | 4 | 4 | 4 | 3 |
| Example 10 | 4 | 4 | 4 | 3 |
| Example 11 | 4 | 4 | 4 | 3 |
| Example 12 | 4 | 4 | 4 | 3 |
| Example 13 | 4 | 4 | 4 | 3 |
| Example 14 | 4 | 4 | 3 | 3 |
| Example 15 | 4 | 4 | 3 | 3 |
| Example 16 | 4 | 4 | 3 | 3 |
| Example 17 | 4 | 4 | 3 | 3 |
| Example 18 | 4 | 4 | 3 | 3 |
| Example 19 | 4 | 3 | 3 | 3 |
| Example 20 | 4 | 3 | 3 | 3 |
| Example 21 | 4 | 3 | 3 | 3 |
| Example 22 | 3 | 3 | 3 | 3 |
| Example 23 | 3 | 3 | 3 | 3 |
| Comparative Example 1 | 3 | 3 | 2 | 1 |
| Comparative Example 2 | 3 | 3 | 2 | 1 |
| Comparative Example 3 | 3 | 3 | 2 | 2 |
| Comparative Example 4 | 3 | 3 | 2 | 1 |
| Comparative Example 5 | 3 | 3 | 3 | 2 |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-014164, filed Jan. 30, 2020, which is hereby incorporated by reference herein in its entirety.

What is claimed is:

1. An electrophotographic photosensitive member comprising an electroconductive support, and a photosensitive layer on the electroconductive support, wherein the electrophotographic photosensitive member comprises a surface layer comprising a cured product of a composition of:

a charge transporting compound having a chain polymerizable functional group selected from the group consisting of chain polymerizable functional groups represented by the following Formulas (1) to (4);

a polymer having a structural unit represented by the following Formula (5) and a structural unit represented by the following Formula (6), and having a weight average molecular weight of 60,000 or more and 129,000 or less; and a polytetrafluoroethylene particle, wherein a number-average particle diameter of primary particles of the polytetrafluoroethylene particle is 150 nm or larger and 195 nm or smaller, an abundance ratio of a polytetrafluoroethylene particle having a primary particle diameter of 150 nm or smaller among the polytetrafluoroethylene particles is 10% by number or more, and an abundance ratio of a polytetrafluoroethylene particle having a primary particle diameter of 250 nm or larger is 5% by number or less:

(1)

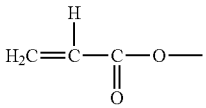

(2)

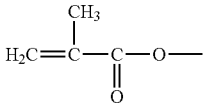

(3)

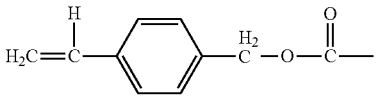

(4)

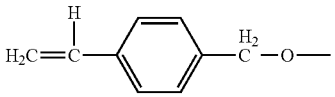

(5)

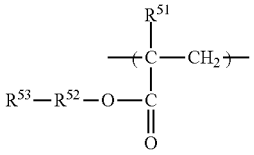

wherein $R^{51}$ represents a hydrogen atom or a methyl group, $R^{52}$ represents an alkylene group, and $R^{53}$ represents a perfluoroalkyl group having 4 or more and 6 or less carbon atoms;

(6)

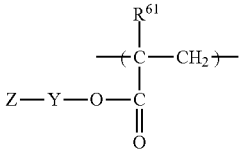

wherein $R^{61}$ represents a hydrogen atom or a methyl group, Y represents a divalent organic group having at least a structure represented by the following Formula (7), and Z represents the following Formula (8);

(7)

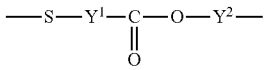

wherein $Y^1$ and $Y^2$ each independently represent an alkylene group; and (8)

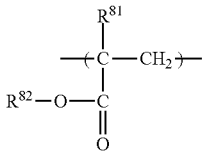

wherein $R^{81}$ represents a hydrogen atom or a methyl group, and $R^{82}$ represents an alkyl group.

2. The electrophotographic photosensitive member according to claim 1, wherein the number-average particle diameter of the primary particles of the polytetrafluoroethylene particle is 170 nm or larger and 190 nm or smaller.

3. The electrophotographic photosensitive member according to claim 1, wherein a content of the polytetrafluoroethylene particle in the surface layer is 20.0 mass % or more and 40.0 mass % or less with respect to a weight of the surface layer.

4. The electrophotographic photosensitive member according to claim 1, wherein a number average molecular weight of the polytetrafluoroethylene particles is 12,000 or more and 20,000 or less.

5. The electrophotographic photosensitive member according to claim 1, wherein the cured product of the composition further contains a charge transporting compound having a chain polymerizable functional group represented by the following Formula (9):

(9)

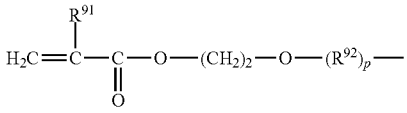

wherein $R^{91}$ represents a hydrogen atom or a methyl group, and $R^{92}$ represents an alkylene group; and p represents 0 or 1.

6. An electrophotographic apparatus comprising: an electrophotographic photosensitive member; and a charging unit, an exposure unit, a developing unit and a transfer unit, wherein the electrophotographic photosensitive member comprises an electroconductive support, and a photosensitive layer on the electroconductive support, wherein the electrophotographic photosensitive member comprises a surface layer comprising a cured product of a composition of:

a charge transporting compound having a chain polymerizable functional group selected from the group consisting of chain polymerizable functional groups represented by the following Formulas (1) to (4);

a polymer having a structural unit represented by the following Formula (5) and a structural unit represented by the following Formula (6), and having a weight average molecular weight of 60,000 or more and 129,000 or less; and a polytetrafluoroethylene particle, wherein a number-average particle diameter of primary particles of the polytetrafluoroethylene particle is 150 nm or larger and 195 nm or smaller, an abundance ratio of a polytetrafluoroethylene particle having a primary particle diameter of 150 nm or smaller among the polytetrafluoroethylene particles is 10% by number or more, and an abundance ratio of a polytetrafluoroethylene particle having a primary particle diameter of 250 nm or larger is 5% by number or less:

(1)

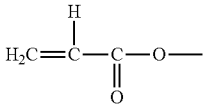

(2)

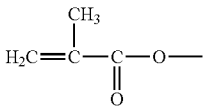

(3)

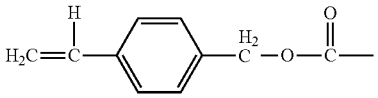

(4)

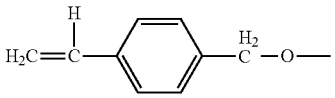

(5)

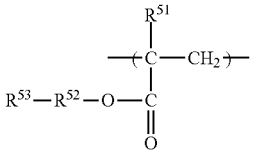

wherein $R^{51}$ represents a hydrogen atom or a methyl group, $R^{52}$ represents an alkylene group, and $R^{53}$ represents a perfluoroalkyl group having 4 or more and 6 or less carbon atoms;

(6)

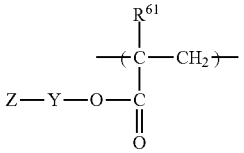

wherein $R^{61}$ represents a hydrogen atom or a methyl group, Y represents a divalent organic group having at least a structure represented by the following Formula (7), and Z represents the following Formula (8);

(7)

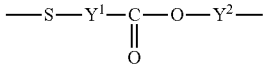

wherein $Y^1$ and $Y^2$ each independently represent an alkylene group; and (8)

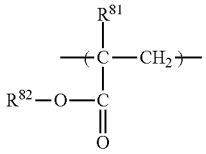

wherein $R^{81}$ represents a hydrogen atom or a methyl group, and $R^{82}$ represents an alkyl group.

7. A process cartridge that integrally supports an electrophotographic photosensitive member and at least one unit selected from the group consisting of a charging unit, a developing unit and a cleaning unit, and is detachably attachable to a main body of an electrophotographic apparatus, wherein the electrophotographic photosensitive member comprises an electroconductive support, and a photosensitive layer on the electroconductive support, wherein the electrophotographic photosensitive member comprises a surface layer comprising a cured product of a composition of:

a charge transporting compound having a chain polymerizable functional group selected from the group consisting of chain polymerizable functional groups represented by the following Formulas (1) to (4);

a polymer having a structural unit represented by the following Formula (5) and a structural unit represented by the following Formula (6), and having a weight average molecular weight of 60,000 or more and 129,000 or less; and a polytetrafluoroethylene particle, wherein a number-average particle diameter of primary particles of the polytetrafluoroethylene particle is 150 nm or larger and 195 nm or smaller, an abundance ratio of a polytetrafluoroethylene particle having a primary particle diameter of 150 nm or smaller among the polytetrafluoroethylene particles is 10% by number or more, and an abundance ratio of a polytetrafluoroethylene particle having a primary particle diameter of 250 nm or larger is 5% by number or less:

(1)

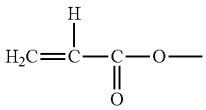

(2)

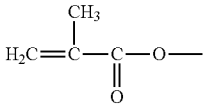

(3)

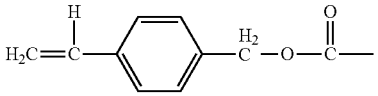

(4)

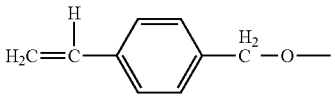

(5)

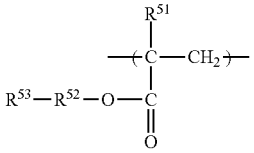

wherein $R^{51}$ represents a hydrogen atom or a methyl group, $R^{52}$ represents an alkylene group, and $R^{53}$ represents a perfluoroalkyl group having 4 or more and 6 or less carbon atoms;

(6)

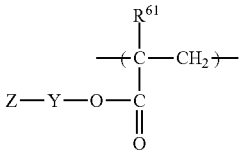

wherein $R^{61}$ represents a hydrogen atom or a methyl group, Y represents a divalent organic group having at least a structure represented by the following Formula (7), and Z represents the following Formula (8);

(7)

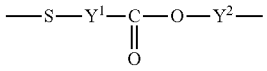

wherein $Y^1$ and $Y^2$ each independently represent an alkylene group; and (8)

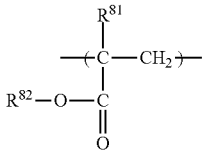

wherein $R^{81}$ represents a hydrogen atom or a methyl group, and $R^{82}$ represents an alkyl group.

* * * * *